US006910599B2

(12) United States Patent
Tucker et al.

(10) Patent No.: US 6,910,599 B2
(45) **Date of Patent: *Jun. 28, 2005**

(54) SEALING CONTAINER

(75) Inventors: Edward Tucker, Romeoville, IL (US); George Lueken, Fort Wayne, IN (US); Luke Gross, Churubusco, IN (US); Mark Cruz, Fort Wayne, IN (US); Jack F. Melvan, Oak Forest, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/272,080

(22) Filed: Oct. 16, 2002

(65) Prior Publication Data

US 2004/0195255 A1 Oct. 7, 2004

Related U.S. Application Data

(63) Continuation of application No. 09/698,776, filed on Oct. 27, 2000, now Pat. No. 6,467,647, which is a continuation-in-part of application No. 08/819,826, filed on Mar. 18, 1997, now Pat. No. 6,170,696.

(51) Int. Cl.[7] ..... B65D 41/16

(52) U.S. Cl. ..... 220/793; 220/781; 220/782; 206/508

(58) Field of Search ..... 220/780, 781, 220/782, 793, 794, 4.21, 4.24, 4.25, 526, 532, 533, 555, 556; 206/508

(56) References Cited

U.S. PATENT DOCUMENTS 3,362,575 A * 1/1968 Fotos ..... 206/508
3,384,265 A * 5/1968 Frank ..... 206/508
3,612,342 A * 10/1971 Rathbun ..... 220/781

(Continued)

*Primary Examiner*—Stephen K. Cronin
(74) *Attorney, Agent, or Firm*—Thomas C. Feix

(57) ABSTRACT

The present invention consists of an inexpensive tight sealing plastic container suited for microwave cooking, top-shelf dishwashing and freezer use. In accordance with a preferred embodiment, the container is provided with two compartments, one large and one small. The container utilizes a dual cut-back closure device of which the retaining bead of the container bottom maintains the container top in a secure position. The inside dimensions of the container top are slightly larger than the container bottom in both compartments. The difference in sizes provides an interference fit and forms a substantially leak proof seal along the inside perimeter of both compartments of the container. The container top provides at least one gripping tab, which facilitates the separation of the container top from the container bottom and permit container venting. In accordance with one embodiment of the invention, the container top is provided with two gripping tabs with one gripping tab allocated to each of the two compartments. In accordance with another embodiment, the closure devices on the container top and bottom are widened at the corner regions.

5 Claims, 37 Drawing Sheets

U.S. PATENT DOCUMENTS 3,722,731 A * 3/1973 McCormick et al. ..... 220/781
3,779,418 A * 12/1973 Davis ..... 220/781
4,186,786 A * 2/1980 Kirkpatrick ..... 383/63
4,285,105 A * 8/1981 Kirkpatrick ..... 24/585.12
4,555,043 A * 11/1985 Bernhardt ..... 220/783
4,593,816 A * 6/1986 Langenbeck ..... 206/425
4,653,685 A * 3/1987 Leary et al. ..... 229/406
4,829,641 A * 5/1989 Williams ..... 24/585.12
4,838,444 A * 6/1989 Bitel ..... 220/4.24
4,907,321 A * 3/1990 Williams ..... 24/585.12
4,917,258 A * 4/1990 Boyd et al. ..... 220/240
4,944,072 A * 7/1990 Robson ..... 24/585.12
5,027,972 A * 7/1991 Bartholomew ..... 220/526
5,070,584 A * 12/1991 Dais et al. ..... 24/585.12
5,094,355 A * 3/1992 Clark et al. ..... 220/4.23
5,138,750 A * 8/1992 Gundlach et al. ..... 24/585.12
5,140,727 A * 8/1992 Dais et al. ..... 24/585.12
5,154,086 A * 10/1992 Porchia et al. ..... 73/818
5,248,201 A * 9/1993 Kettner et al. ..... 383/63
5,252,281 A * 10/1993 Kettner et al. ..... 264/173.17
5,348,181 A * 9/1994 Smith et al. ..... 220/254.3
5,356,222 A * 10/1994 Kettner et al. ..... 383/63
5,363,540 A * 11/1994 Dais et al. ..... 24/585.12
5,377,860 A * 1/1995 Littlejohn et al. ..... 220/790
5,403,094 A * 4/1995 Tomic ..... 383/63
5,427,266 A * 6/1995 Yun ..... 220/377
5,553,701 A * 9/1996 Jarecki et al. ..... 206/15.2
5,730,311 A * 3/1998 Curtis ..... 220/371
5,730,313 A * 3/1998 Hayes et al. ..... 220/526
5,762,231 A * 6/1998 Rider, Jr. et al. ..... 220/526
5,772,070 A * 6/1998 Hayes et al. ..... 220/781
6,032,827 A * 3/2000 Zettle et al. ..... 220/788

* cited by examiner

SEALING CONTAINER

RELATED APPLICATIONS

This application is a continuation of U.S. application Ser. No. 09/698,776, filed Oct. 27, 2000, now U.S. Pat. No. 6,467,647, which is a continuation-in-part of U.S. application Ser. No. 08/819,826, filed Mar. 18, 1997, now U.S. Pat. No. 6,170,696.

FIELD OF THE INVENTION

The invention relates to sealing containers and more particularly, to a multiple compartment sealing container and to closure device and corner tab feature for such containers.

BACKGROUND OF THE INVENTION

Rigid thermoplastic food containers may be classified into two distinct categories. The first category of containers include containers that the consumer acquires during the purchase of dairy or deli foods at a retail store. This type of container is often referred to as an "inexpensive" container since usually the consumer's intention is to purchase the food in the container irrespective of the type of container. Since the consumer pays the retail price necessary to purchase the food, they often think of the container as an inexpensive item which they may save for re-use at a later date.

With respect to this first type of container, a group includes the inexpensive convenience containers which consumers frequently acquire when purchasing deli foods. Generally, these "deli" containers need only to perform the function of providing a highly visible display and to provide containment of solid foods, such as, bakery items, salads or fruit at refrigeration temperature to ambient temperature. Often, the material of choice is a high clarity grade of APET (amorphous polyethylene terephthalate) or PS (polystyrene) and the containers are manufactured into many shapes by a thermoforming process so as to provide wall thicknesses of about 10–20 mils. This wall thickness range represents the low end of wall thicknesses generally seen in rigid thermoplastic food containers and as a consequence the containers can be made very inexpensively. Thus, the consumer may consequence the containers can be made very inexpensively. Thus, the consumer may deem the container disposable, i.e. discardable without significant monetary loss that can be attributed to the cost of acquiring the container. In addition, the weight to volume ratio (i.e. the weight of the container over the volume of the container) of these containers is approximately 33.8–37.2 grams/liter for the total of the top and bottom of the container.

Since these deli containers have no elevated temperature requirements and thus can be formed from APET or PS, their low heat distortion temperature makes them highly unsuitable for microwave cooking applications. Furthermore, because the containers are not designed to provide a secure seal for liquid foods, the containers may leak if inverted while attempting to contain such foods during re-use by the consumer. Also, because the materials of construction are generally brittle, these containers will generally crack if stressed mechanically and thus are not very durable. Although these "deli" containers are inexpensive, their lack of heat resistance, durability and poor sealing characteristics severally limit their use.

"Dairy" containers also represent another group of thermoplastic containers that can be characterized as "inexpensive." These containers are designed to hold butters, fresh and processed cheeses, yogurts, and read-serve sauces at retail. Often these containers are filled by a food producer while the food contents are hot enough to flow freely into the container. In these cases, the materials of choice for such containers are generally PP (polypropylene) or HDPE (high density polyethylene) owing to their elevated temperature performance characteristics. The container bottoms are manufactured by an injection molding or thermoforming process. The container bottoms made by injection molding have a wall thickness of about 20–40 mils. The container bottoms made by thermoforming have a wall thickness of about 10–20 mils. Like the "deli" containers, the "dairy" containers can be made very inexpensively and as such the consumer may deem the container disposable after limited re-use. The weight to volume ratio of the injection molded containers is approximately 43.9–57.4 grams/liter for the total of the top and bottom of the container. The weight to volume ratio of the thermoformed containers is approximately 37.2–54.1 grams/liter for the total of the top and bottom of the container.

These dairy containers almost always are formed into a round, somewhat cylindrical shape which is well suited to the requirements of high speed labeling equipment. The cylindrical shape is an inefficient shape compared to other shapes such as a rectangle or square with regard to storage space utilization.

Also the dairy containers should prevent moisture loss, oxygen permeation, and odor absorption which if not prevented would undesirably alter the food contents. The food producer solves these problems by completely enclosing the head space above the food by application of a lidding material, such as, foil or thermoplastic barrier film which is continuously sealed to the upper lip of the container bottom. The container generally will also include a removable rigid thermoplastic lid that is placed over the continuously sealed lidding foil or film so that puncture protection is provided. The lid has a wall thickness of about 10 to 20 mils. The rigid thermoplastic container lid usually engages the container bottom so as to provide a crude fit, but it does not have to provide a secure leakproof seal since the lidding material accomplishes this function. Thus when the consumer goes to re-use the container, they may find that the container's seal is unsuitable for rough transport and handling of liquid foods, since the lidding material has been peeled off during consumption of the original contents and only the crude fitting rigid lid remains.

The lid is usually made from a softer polyethylene material which often does not have the same heat resistance of the container bottom. Thus, when the consumer goes to re-use the container, they may find that the lid is easily distorted during microwave heating.

Finally, the dairy container materials are usually highly pigmented to provide opacity in order to prevent light-induced oxidation of fat-containing dairy products so as to extend store shelf-life. The consumer may prefer a see-through container which allows easy recognition of food contents during re-use of the container. Thus, dairy containers would be unsuitable in this regard. Although these dairy containers are inexpensive, their round shape, lack of a heat resistant lid, poor sealing characteristics, and opacity severely limit their re-use after the original food contents have been consumed.

For example, many consumers choose to take their lunch to work. While in transit, containers are frequently resting on uneven surfaces or being jostled from ordinary movements, and as a result, the contents of an inexpensive container may leak onto clothing, upholstery, and/or other food. In addition, the inexpensive containers may not be suitable for microwave use, and the food must be removed from the container and placed on dishware suitable for microwave cooking before being heated.

The second category of food containers consists of expensive durable containers which may utilize more expensive plastic materials and thick container walls. These containers address the shortcomings of the inexpensive containers in that they may be suitable for microwave, dishwasher, and freezer use and provide a secure seal which will not leak. However, these containers may employ costly materials. In addition, due to their sophisticated design elements, these containers generally require heavier construction to enable manufacture within the limitations associated with the injection molding process from which these containers are made. These containers have wall thicknesses of about 20 to 80 mils. Thus, this second category of containers become too expensive for disposable use. As a result, a consumer taking his or her lunch to work in an expensive durable container must be burdened with also transporting the container from work to home. The weight to volume ratio of these containers is approximately 67.6–219.6 grams/liter for the total of the top and bottom of the container.

Thus, it would be advantageous if a container were available that possessed the durability, sealing characteristics and features (i.e. microwaveable, freezable, and dishwasher safe) of the expensive containers at a cost which affords the user the option to dispose of it either after very limited use or after extended use.

OBJECTS OF THE INVENTION

It is a general object of the present invention to provide a multi-compartment food container having a tight leak proof seal around each compartment of the container that is inexpensive for disposable use. Another object of the present invention is to provide a semi-transparent container to ensure satisfactory visibility of the container contents. Another object of the present invention is to provide a container that is suited for microwave use. A further object of the invention is to create a container that is top-shelf dishwasher safe. Another object of the present invention is to provide a container that maintains its sealing characteristics while in freezer type temperatures.

A further object of the present invention is to provide a corner tab feature that will facilitate removing the container top from the container bottom. Another object of the invention is to provide a container top which may be positioned in a manner to permit container venting.

Another object of the present invention is to provide a container top which will receive a container bottom during container stacking. Another object of the invention is to provide a container bottom which is nestable with other container bottoms. A further object of the present invention is to provide a container top which is nestable with other container tops.

Another object of the present invention is to provide a sealable container which reduces manufacturing costs, while enabling diverse shapes other than round, such as, rectangle or square.

SUMMARY OF THE INVENTION

The present invention consists of an inexpensive tight sealing plastic container suited for microwave cooking, top-shelf dishwashing and freezer use. In accordance with a preferred embodiment, the container is provided with two compartments, one large and one small. The container utilizes a dual cut-back closure device of which the retaining bead of the container bottom maintains the container top in a secure position. The inside dimensions of the container top are slightly larger than the container bottom in both compartments. The difference in sizes provides an interference fit and forms a substantially leak proof seal along the inside perimeter of both compartments of the container. The container top provides at least one gripping tab, which facilitates the separation of the container top from the container bottom and permit container venting. In accordance with one embodiment of the invention, the container top is provided with two gripping tabs with one gripping tab allocated to each of the two compartments. In accordance with another embodiment, the closure devices on the container top and bottom are widened at the corner regions. Each of the four corners of the container top is provided with surface texturing in the form of upraised ribs to improve handling by a user.

Methods and apparatus which incorporate the features described above and which are effective to function as described above constitute further specific objects of the invention. Other objects and advantages of the invention will become apparent upon reading the following description and upon reference to the drawings.

BRIEF DESCRIPTION OF THE DRAWINGS

For a more complete understanding of this invention reference should now be had to the embodiments illustrated in greater detail in the accompanying drawings and described below by ways of examples of the invention. In the drawings:

FIG. 1 is a bottom perspective view of a container having a top and bottom for food or the like;

FIG. 18 is a bottom perspective view of another embodiment of a container having a top and bottom for food or the like;

FIG. 32 is a bottom perspective view of a dual compartment container having a top and bottom for food or the like;

DETAILED DESCRIPTION OF THE DRAWINGS

Figure 1:
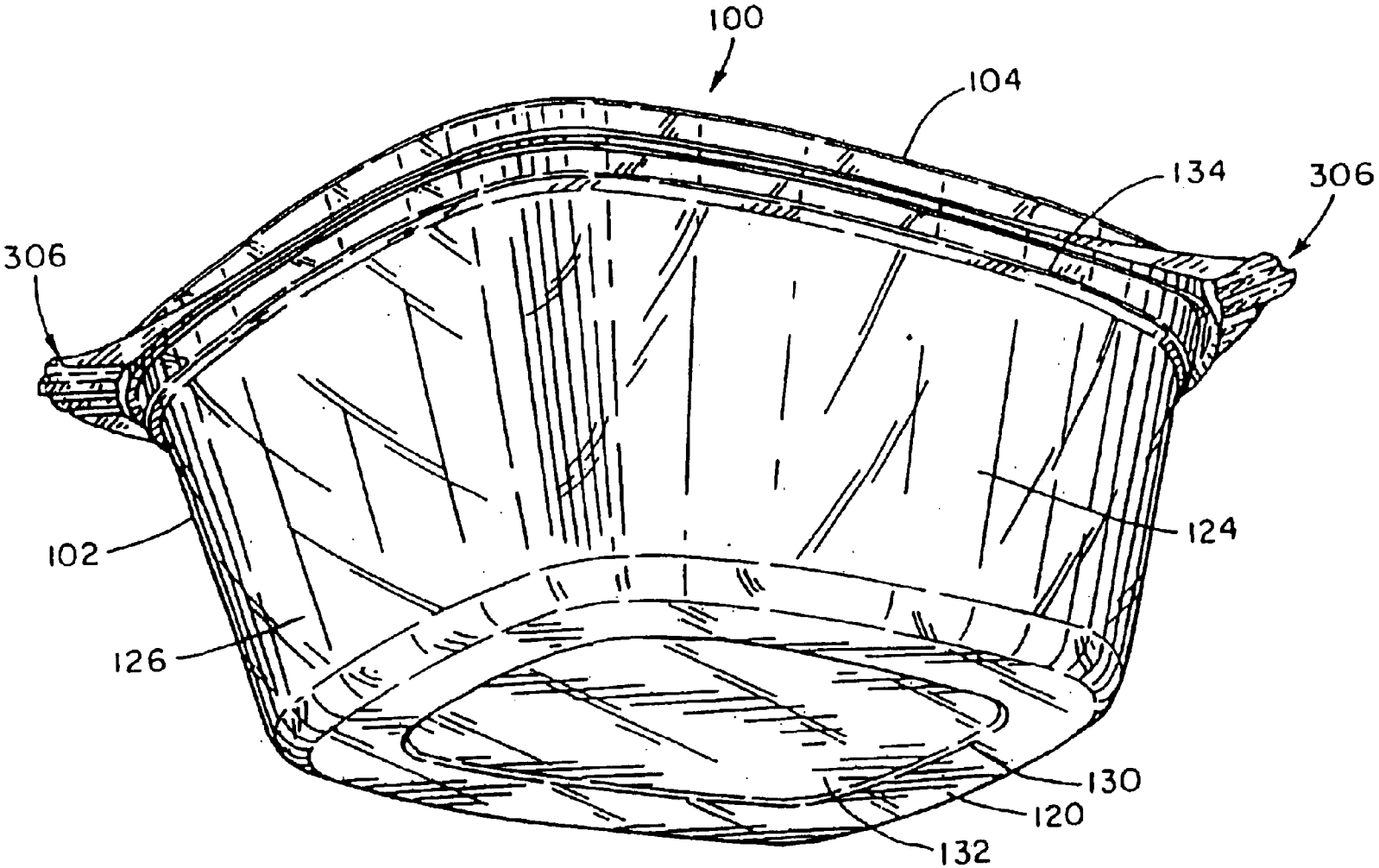
Figure 2:
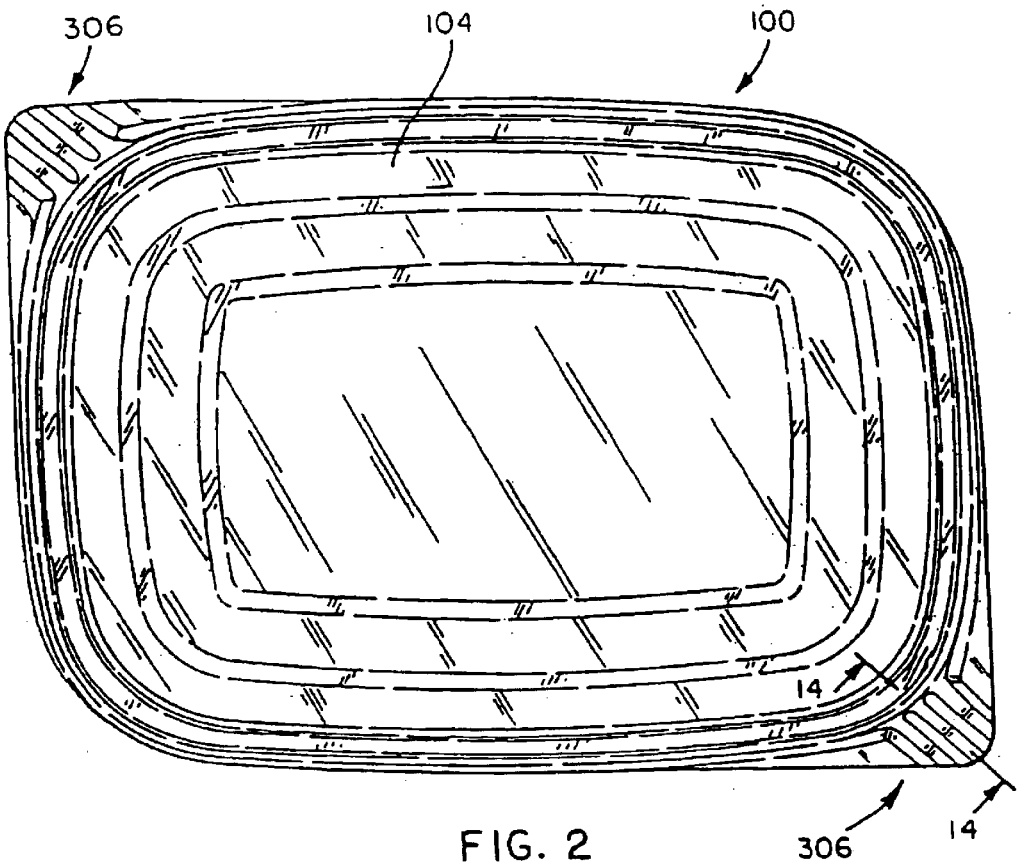
FIG. 2 is a top plan view.
Figure 3:
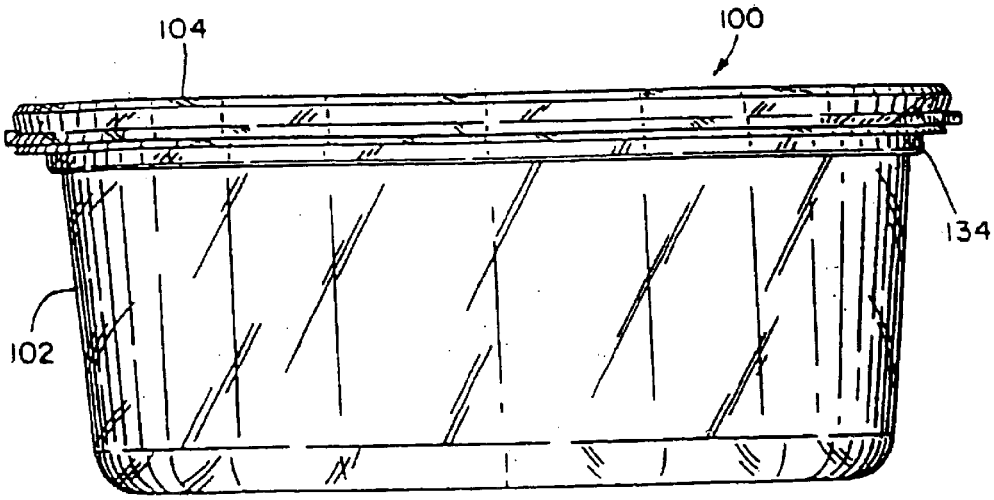
FIG. 3 is a side elevation view.

Referring to FIG. 1, the container 100 consists of a flexible plastic container bottom 102 which is sealingly closed by a flexible plastic container top 104.

Figure 6:
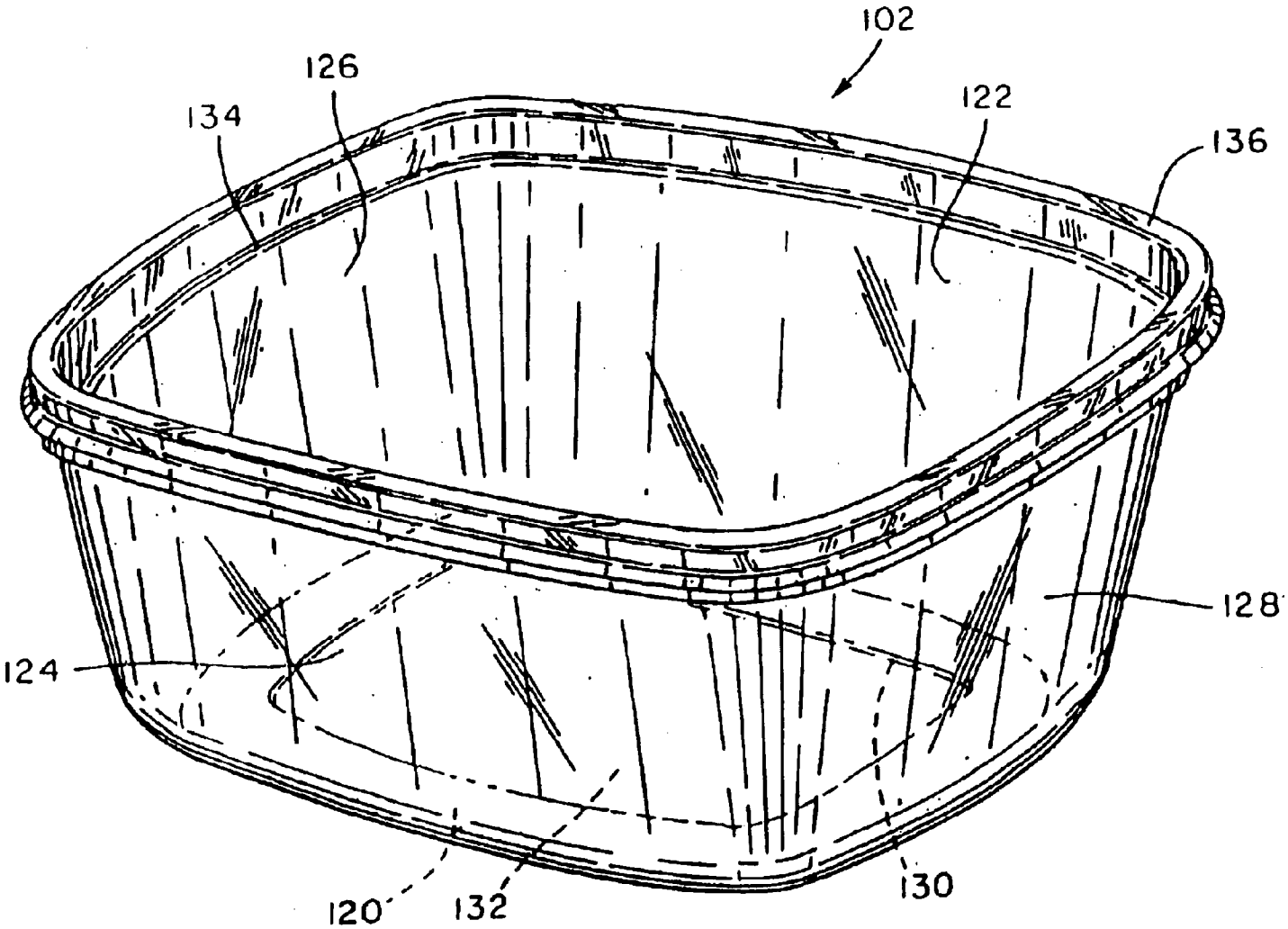
FIG. 6 is a perspective view of the container bottom.
Figure 7:
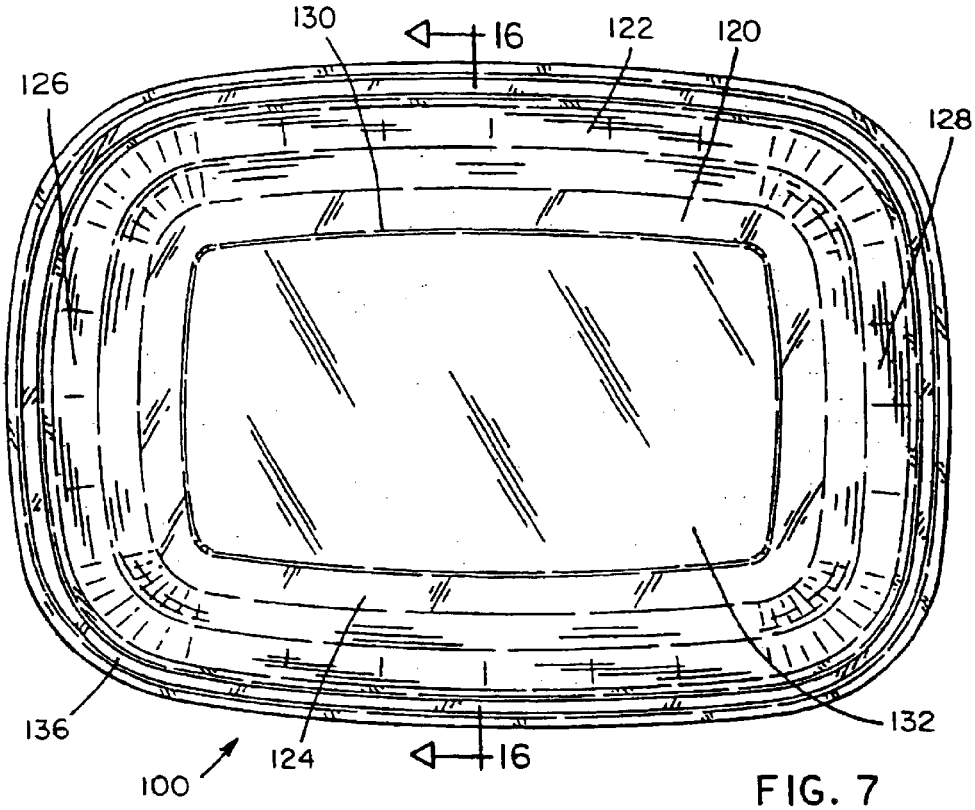
FIG. 7 is a top plan view of the container bottom.
Figure 8:
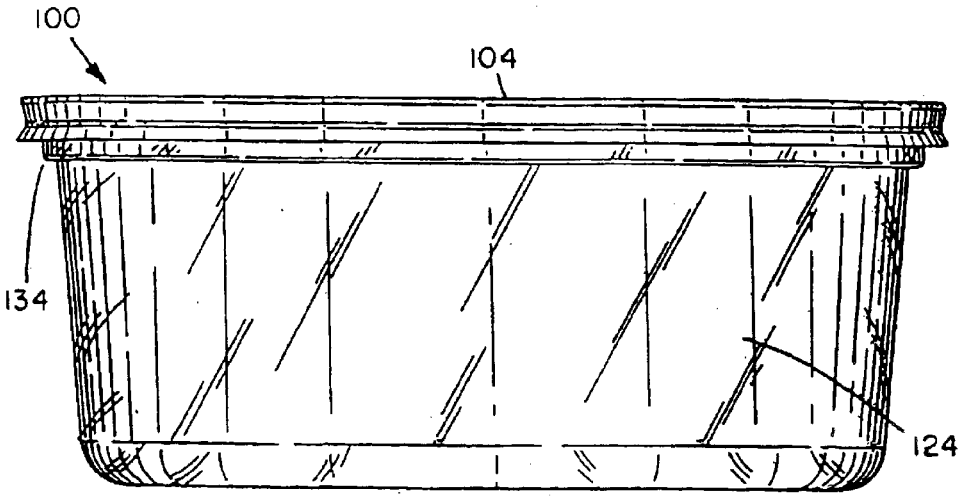
FIG. 8 is a side elevation view of the container bottom.
Figure 9:
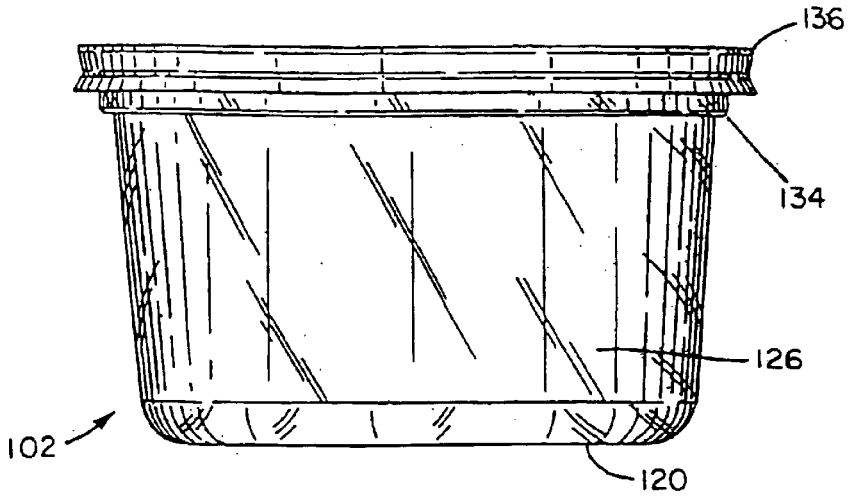
FIG. 9 is an end elevation view of the container bottom.
Figure 10:
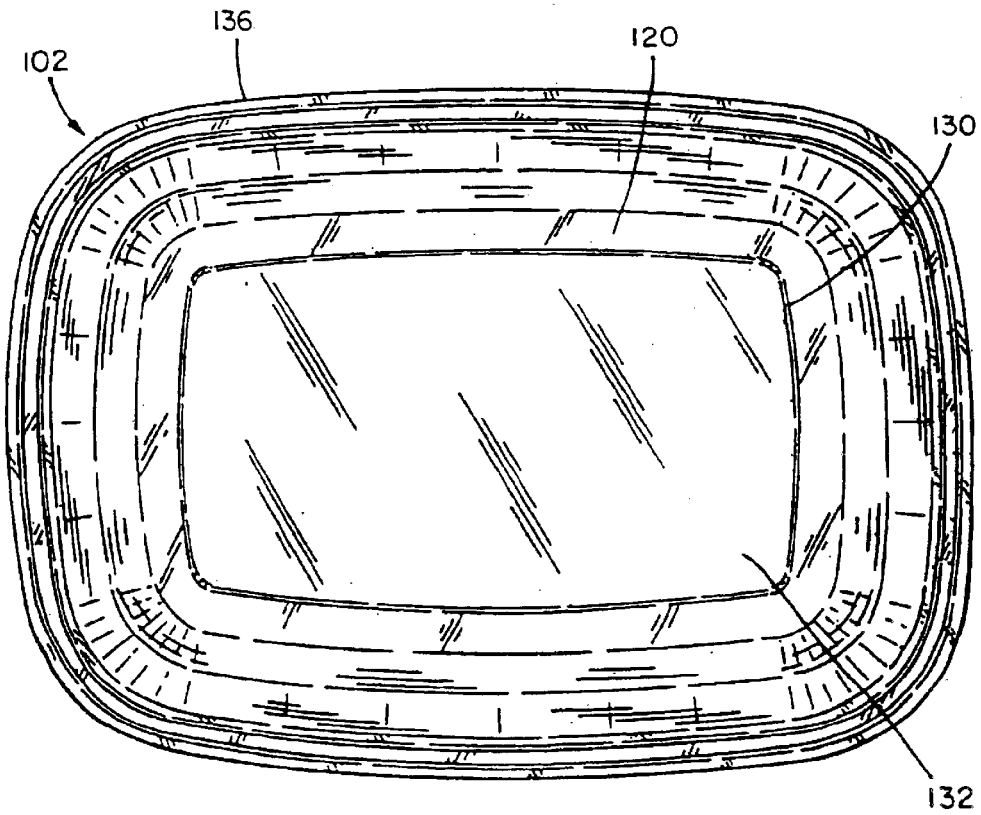
FIG. 10 is a bottom plan view of the container bottom.

As illustrated in FIG. 6, the container bottom 102, has a bottom surface 120, four sidewalls 122, 124, 126, 128, a stacking recess 130, a denesting shoulder 134, and a closure device 136.

The sidewalls 122, 124, 126, 128 extend upwardly and slightly outwardly from the periphery of the bottom surface 120. At the termination of the sidewalls, an outwardly and substantially horizontally extending denesting shoulder 134 is provided which merges into the base of the closure device 136. The bottom surface 120 provides a stacking recess 130 extending upwardly to an upper substantially horizontal surface 132.

Figure 16:
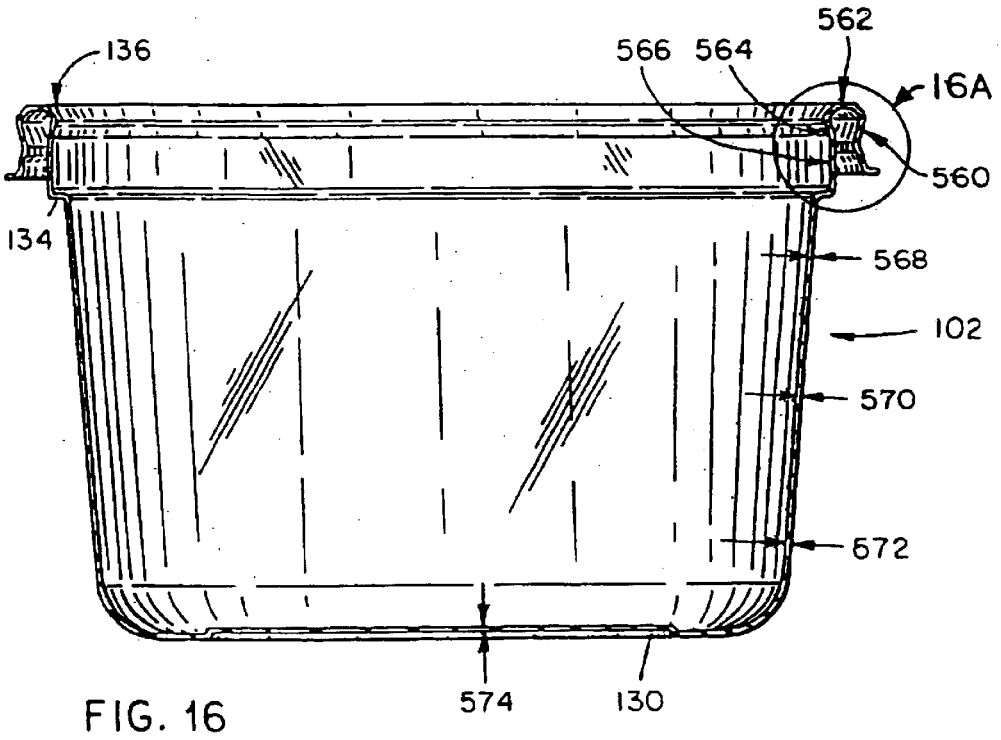
FIG. 16 is a cross-sectional view taken along line 16—16 of FIG. 7.
Figure 16A:
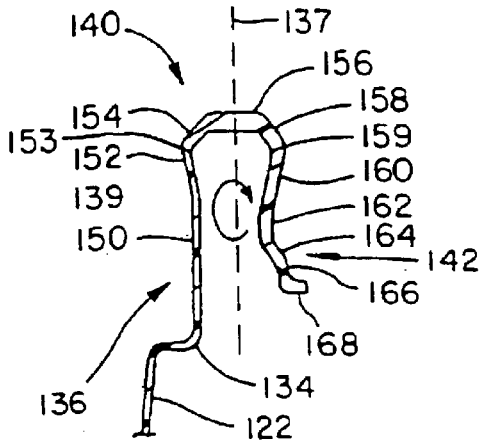
FIG. 16A is an enlarged partial view of area 16A in FIG. 16.

Referring to FIG. 16A, the closure device 136 comprises an inner vertical sealing wall 150, a retention bead 140, an outer vertical wall 162 and a skirt 142. The terms "inner" and "outer" are used with respect to the reference line 137 shown in FIG. 16A. The terms "inwardly" and "outwardly" are used with respect to the reference line 137 and moving in a clockwise direction 139 as shown in FIG. 16A.

The vertical sealing wall 150 extends from the denesting shoulder 134 and merges into the retention bead 140. The retention bead 140 may include an upwardly and outwardly extending cut-back portion 152, an inner vertical portion 153, an upwardly and inwardly extending lead-in portion 154, a horizontal rim surface 156, a downwardly and outwardly extending lead-in portion 158, an outer vertical portion 159, and a downwardly and inwardly extending cut-back portion 160.

The outer vertical wall 162 joins the retention bead 140 and the skirt 142. The skirt 142 may include a first downwardly and outwardly extending portion 164, a second downwardly and outwardly extending portion 166 of a more vertical position than the first portion 164, and a substantially horizontal lip 168.

Figure 4:
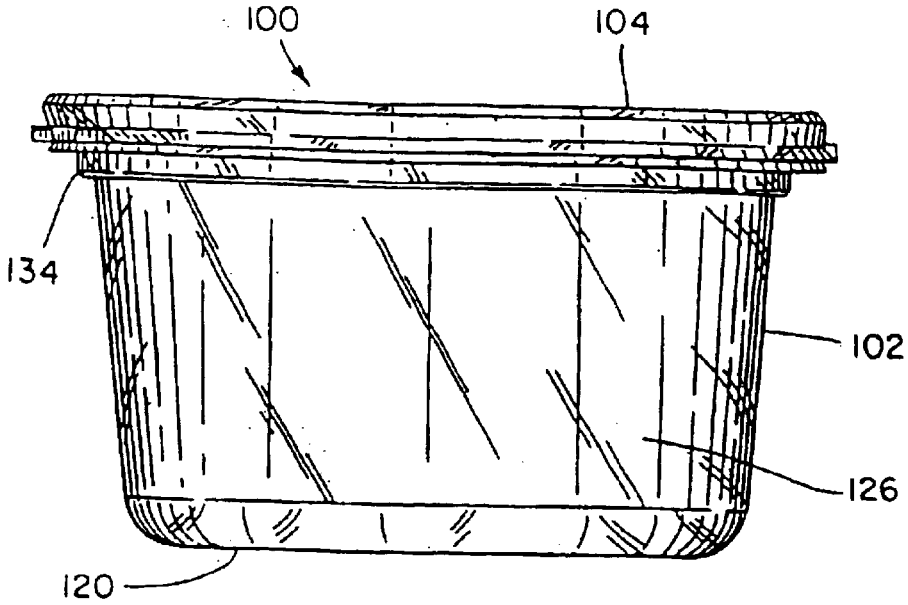
FIG. 4 is an end elevation view.
Figure 4A:
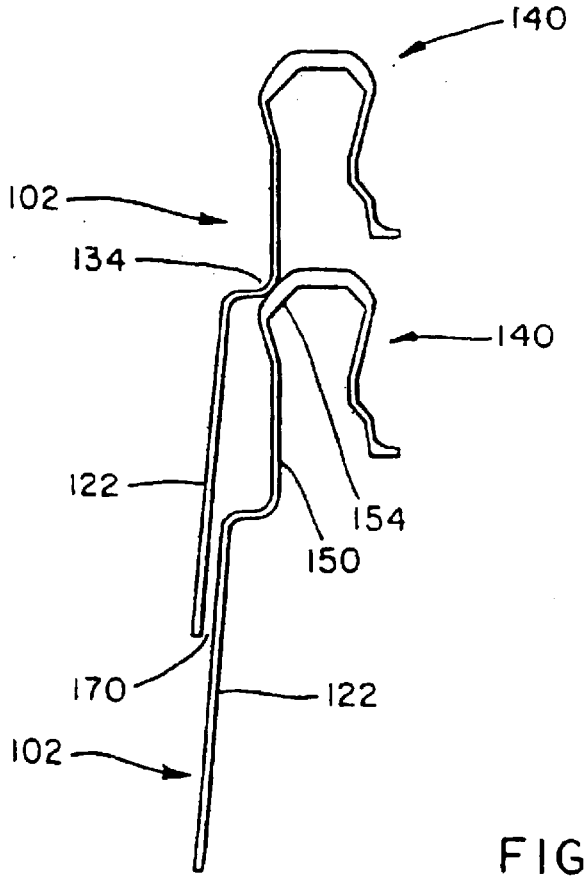
FIG. 4A is a partial cross-sectional view (similar to the view of FIG. 16B) of stacked container bottoms.
Figure 5:
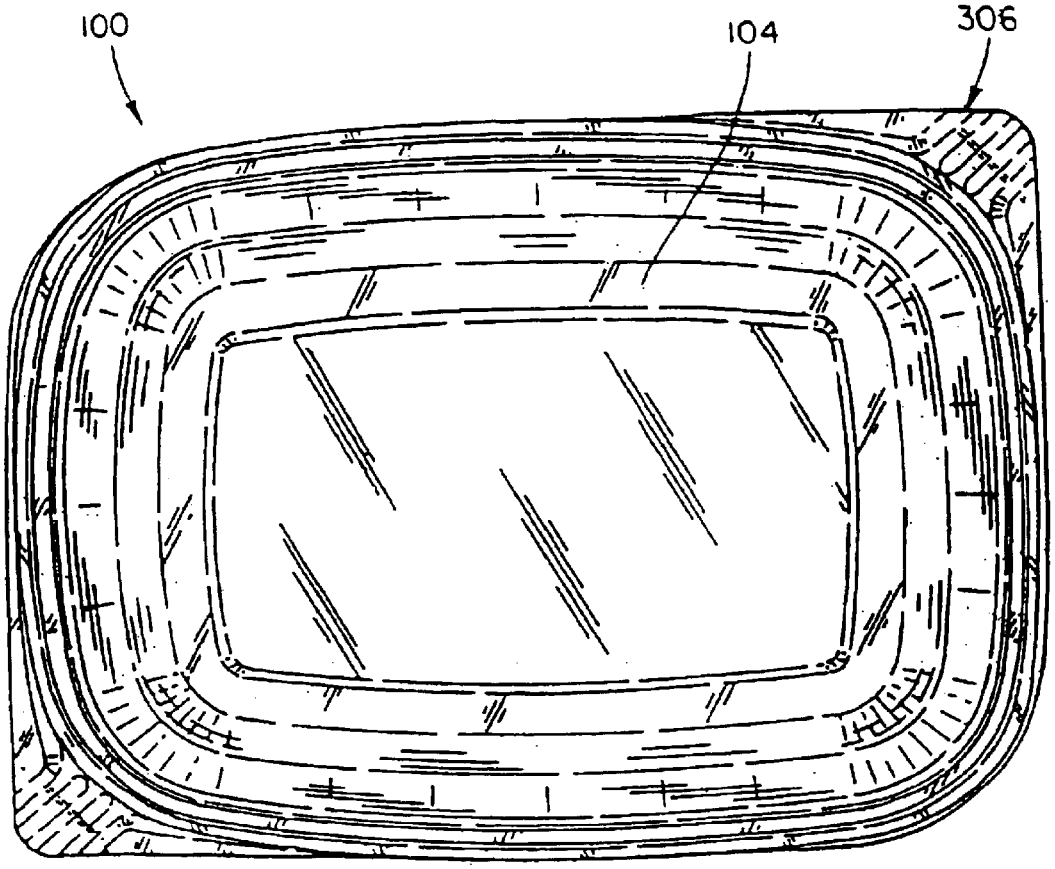
FIG. 5 is a bottom plan view.

As shown in FIG. 4A the container bottoms may be stacked together in a nested formation. When the container bottoms 102 are nested, the denesting shoulder 134 of the upper container bottom rests on the upwardly and inwardly extending lead-in portion 154 of the lower container bottom. The inner vertical sealing wall 150 of the container bottom 102 is designed of a necessary length to maintain an air space 170 between the sidewalls 122 of the lower container bottom and the sidewalls 122 of the upper container bottom such that the interlocking of container bottoms is avoided. The height of the vertical sealing wall 150 is dictated by the draft angle of the sidewall 122. Furthermore, the container bottoms 102 provide a low stacking height when nested together to facilitate packaging and minimize storage space.

Figure 16C:
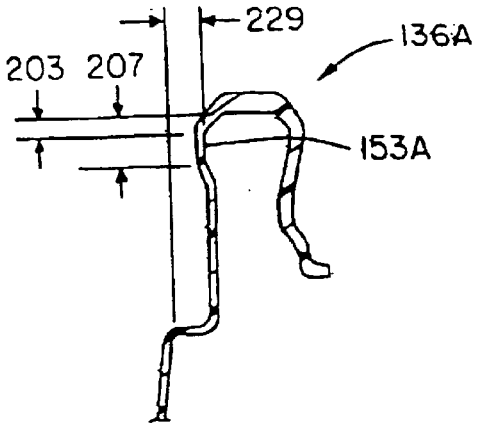
FIG. 16C is another embodiment of the closure device for the container bottom.
Figure 16B:
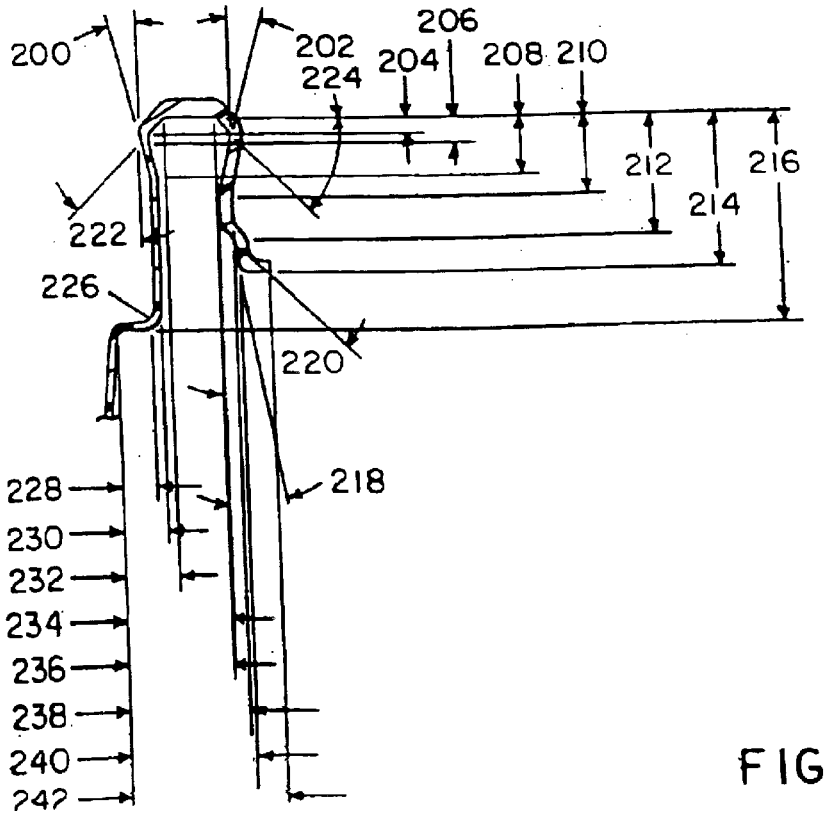
FIG. 16B is the view of FIG. 16A with dimensional parameters.

FIG. 16B represents a container bottom closure device 136 of the present invention. The representative dimensions of the various parameters are given as follows:

| PARAMETER | FIRST RANGE | SECOND RANGE | PREFERRED |
|---|---|---|---|
| 200 | 5–20 degrees | 8–16 degrees | 15 degrees |
| 202 | 5–20 degrees | 8–16 degrees | 15 degrees |
| 204 | 17–140 mils | — | 35 mils |
| 206 | 25–200 mils | — | 50 mils |
| 208 | 60–484 mils | — | 121 mils |
| 210 | 81–648 mils | — | 162 mils |
| 211 | 105–844 mils | | 216 mils |
| 212 | 123–984 mils | — | 246 mils |
| 214 | 156–1248 mils | — | 312 mils |
| 216 | 211–1688 mils | — | 422 mils |
| 218 | 0–80 degrees | 5–45 degrees | 10 degrees |
| 220 | 10–80 degrees | 25–65 degrees | 45 degrees |
| 222 | 10–80 degrees | 25–65 degrees | 45 degrees |
| 224 | 10–80 degrees | 25–65 degrees | 45 degrees |
| 226 | 20–160 mils | — | 40 mils (radius) |
| 228 | 37–296 mils | — | 74 mils |
| 230 | 46–372 mils | — | 93 mils |
| 232 | 54–436 mils | — | 109 mils |
| 234 | 112–900 mils | — | 225 mils |
| 236 | 115–920 mils | — | 230 mils |
| 238 | 130–1040 mils | — | 260 mils |
| 240 | 136–1088 mils | — | 272 mils |
| 242 | 164–1312 mils | — | 328 mils |

FIG. 16C represents another embodiment of a closure device 136A for the container bottom. The closure device 136A is the same as closure device 136 except the inner vertical portion 153A is longer than the inner vertical portion 153 of closure device 136. The representative dimensions of the parameters which are different from FIG. 16B are given as follows:

| PARAMETER | FIRST RANGE | SECOND RANGE | PREFERRED |
|---|---|---|---|
| 203 | 14–112 mils | — | 28 mils |
| 207 | 38–304 mils | — | 76 mils |
| 229 | 41–324 mils | — | 81 mils |

Figure 11:
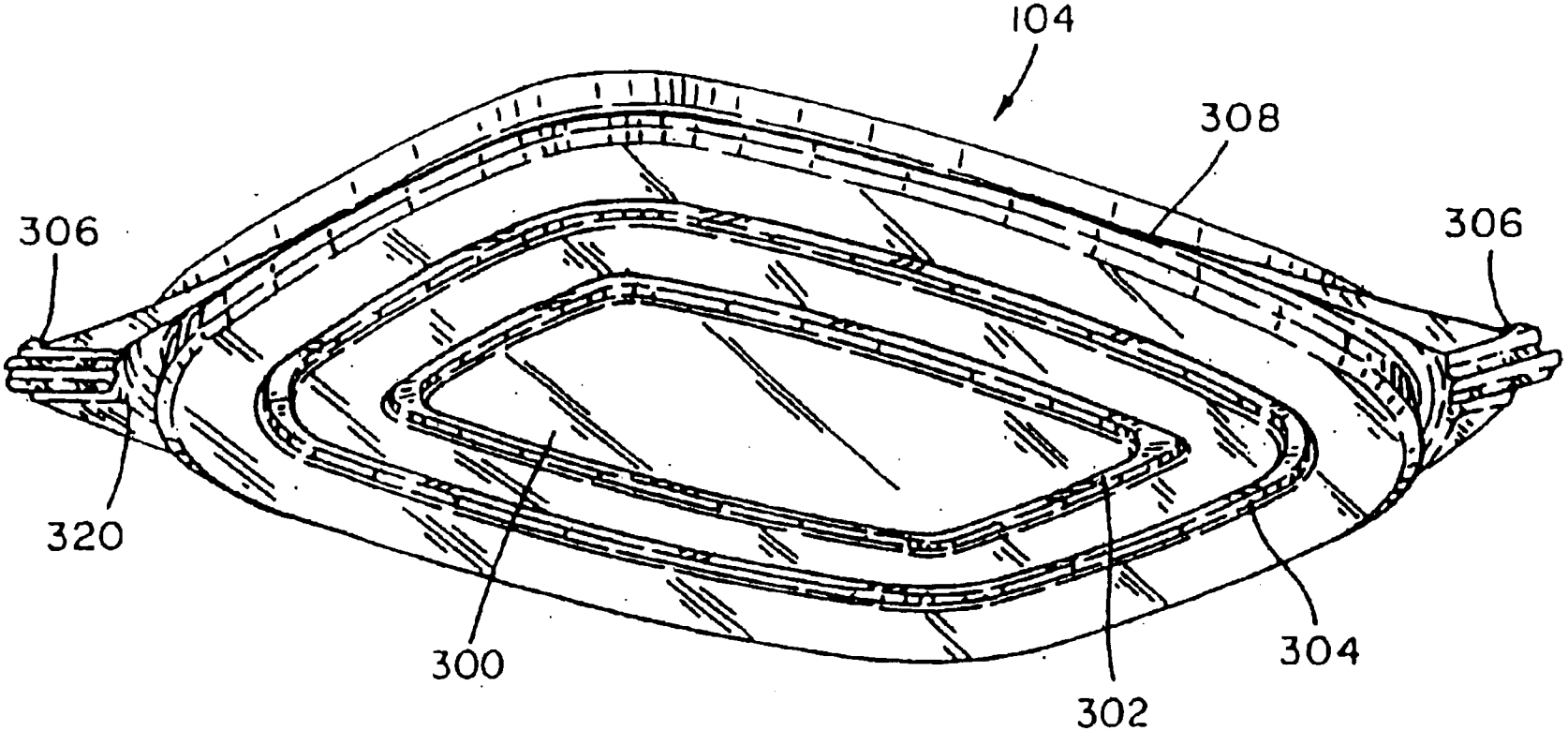
FIG. 11 is a bottom perspective view of the container top.

The container top 104 as illustrated in FIG. 11 comprises a bottom surface 300, an inner stacking bead 302, an outer stacking bead 304, gripping tabs 306 and a closure device 308.

Figure 17:
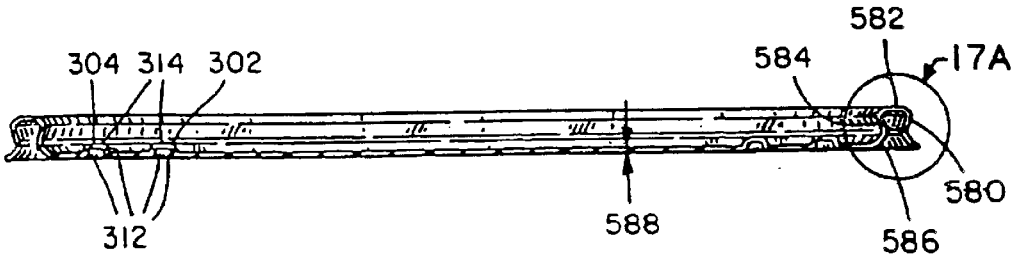
FIG. 17 is a cross-sectional view taken along line 17—17 of FIG. 12.

Referring to FIG. 17, each stacking bead 302, 304 may include an inner vertical portion 310 and an outer vertical portion 312 and a horizontal portion 314 such that an inverted "U" shape is formed. The inner stacking bead 302 runs continuously along the bottom surface 300 forming a substantially rectangular ring as viewed in FIG. 12. The outer stacking bead 304 also runs continuously along the bottom surface 300, forming a substantially rectangular ring outside the perimeter of the inner stacking bead 302 and inside the perimeter of the closure device 308.

Figure 17B:
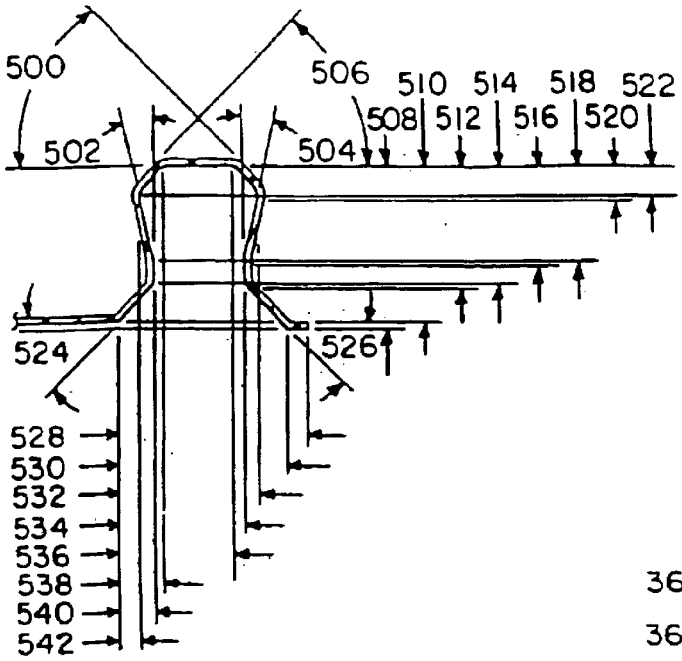
FIG. 17B is the view of FIG. 17A with dimensional parameters.
Figure 17A:
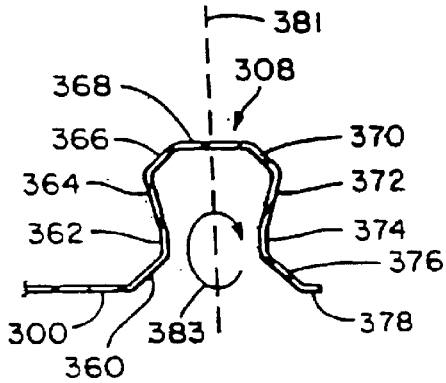
FIG. 17A is an enlarged partial view of area 17A in FIG. 17.
Figure 17C:
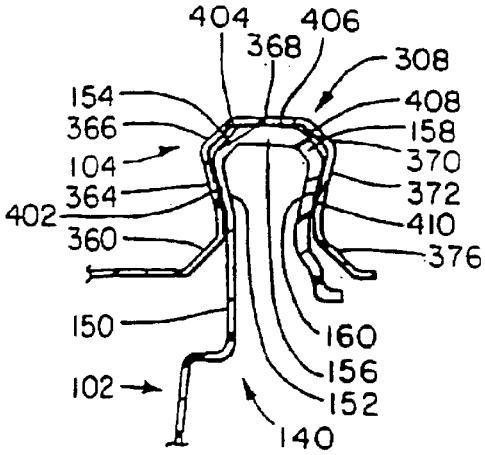
FIG. 17C is the view of FIGS. 16A and 17A in an engaged position.
Figure 17D:
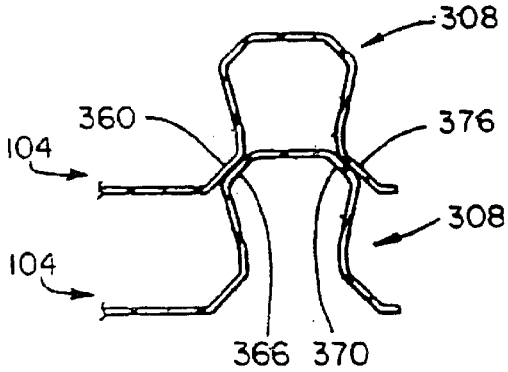
FIG. 17D is the view of FIG. 17A in a stacked formation.
Figure 17E:
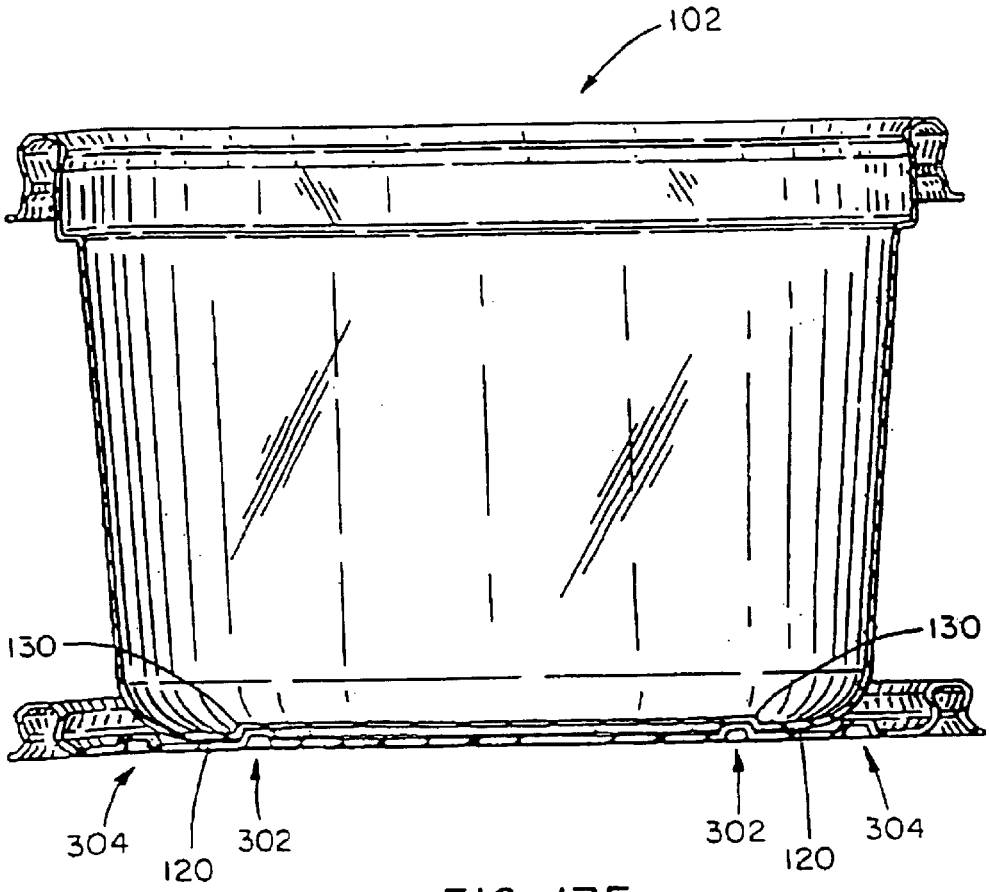
FIG. 17E is a cross-sectional view of the container bottom in FIG. 16 and the container top in FIG. 17 in a stacked formation.

As depicted in FIG. 17E, the inner stacking bead 302 of the container top 104 is adapted to fit within the stacking recess 130 of the container bottom. The outer bead 304 is designed to secure the perimeter of the bottom surface 120 of the container bottom 102. The stacking beads 302, 304 keep the closed containers in vertical alignment when placed in a stacked position thereby minimizing shelf space within a cabinet, refrigerator or freezer while providing for a stable stack.

The gripping tabs 306 are formed adjacent to the corners of the container top, outside the perimeter of the closure device 308. As viewed in FIG. 12, the tabs 306 are located at opposite corners of the container top 104 such that a tab in the top left-hand corner of the container top would have a corresponding tab in the lower right-hand corner of the container top.

Referring to FIGS. 12–15, each tab 306 comprises three upper inverted "U" shaped ribs 316 and two lower "U" shaped ribs 318 all of which extend outwardly from the periphery of the container top. The ribs 316, 318 have a reinforcing and stiffening effect which provide a means of leverage in separating the container top 104 from the container bottom 102. The ribs 316, 318 further provide a frictional gripping surface to minimize slippage when grasping the tab 306.

Figure 15:
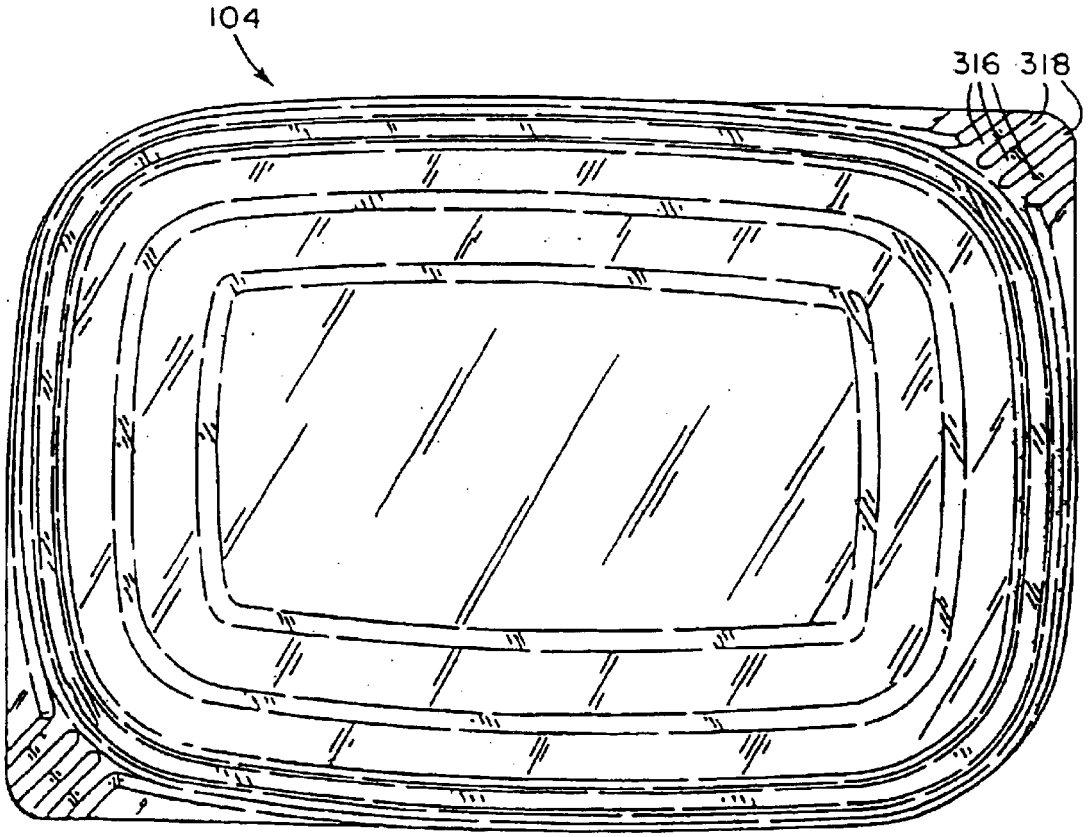
FIG. 15 is a top plan view of the container top.
Figure 15A:
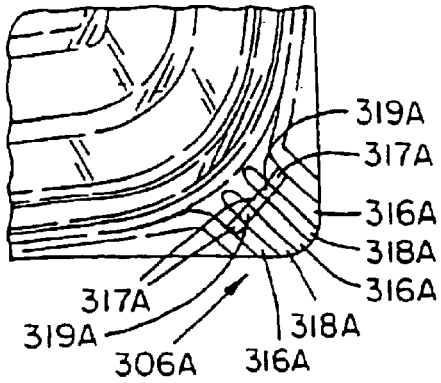
FIG. 15A is a top plan view of another embodiment of a tab for the container top.
Figure 15B:
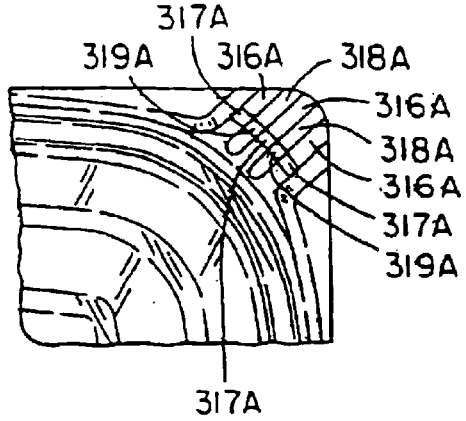
FIG. 15B is a bottom plan view of the tab in FIG. 15A.
Figure 15C:
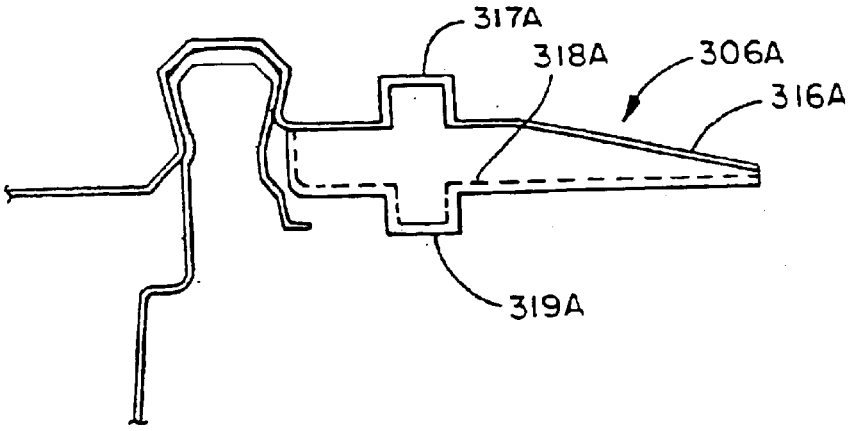
FIG. 15C is a cross sectional view of the tab in FIGS. 15A and 15B.

The gripping tab may also include cross-ribs to improve the grip on the tab. The cross-ribs may be perpendicular to the other ribs or the tab may only include the cross-ribs. Referring to FIGS. 15A–15C, the tab 306A includes three upper inverted "U" shaped ribs 316A and two lower "U" shaped ribs 318A. In addition, the tab 306A also includes upper cross ribs 317A on the upper ribs 316A and lower cross ribs 319A on the lower ribs 318A. If necessary, the tab may include another set of cross-ribs located near the outside edge of the tab. In another embodiment, the tab includes the upper and lower ribs 316A, 318A and the upper cross ribs 317A, but not the lower cross ribs 319A. In a further embodiment, the tab includes the upper and lower ribs 316A, 318A and the lower cross ribs 319A, but not the upper cross ribs 317A. In yet another embodiment, the upper and lower ribs 316A, 318A are eliminated from the tab and instead the tab includes the upper cross ribs 317A and/or the lower cross ribs 319A.

Figure 15D:
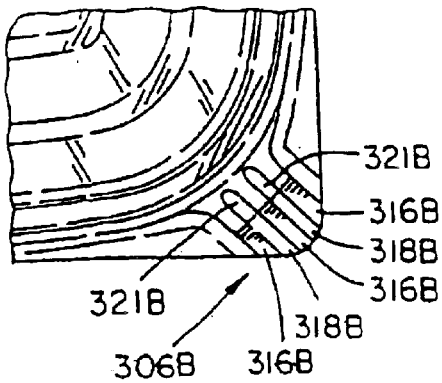
FIG. 15D is a top plan view of another embodiment of a tab for the container top.
Figure 15E:
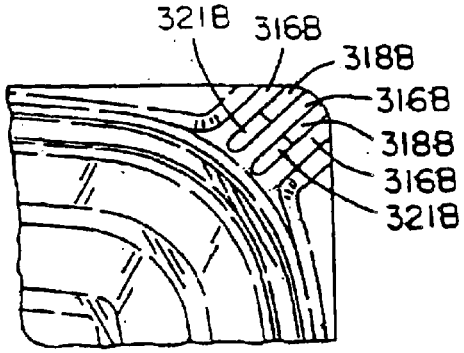
FIG. 15E is a bottom plan view of the tab in FIG. 15D.
Figure 15F:
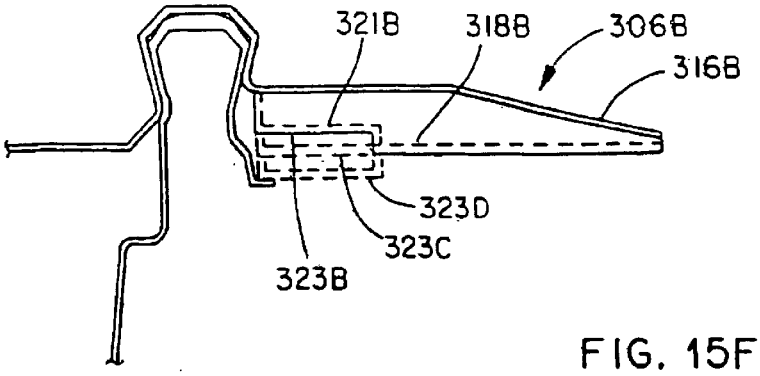
FIG. 15F is a cross sectional view of the tab in FIGS. 15A and 15B.

Furthermore, the tab 306B may include an indented portion on the tab or on the ribs to improve the grip on the tab. Referring to FIGS. 15D–15F, the tab 306B includes three upper inverted "U" shaped ribs 316B and two lower "U" shaped ribs 318B. In addition, the tab 306B also includes an indented portion 321B on the lower ribs 318B. If necessary, the tab may include another set of indented portions near the outside of the tab. The tab may be manufactured with the indented portion in the indented position 323B. In other embodiments, the tab may be manufactured with the indented portion in the neutral position 323C or the extended position 323D and when the user grips the tab, the indented portion collapses to indented position 323B. The indented portion collapses because the material is thinner at the indented portion than the surrounding portions of the tab.

In another embodiment, the indented portion(s) could be located on the upper rib(s) 316B. In a further embodiment, the upper and lower ribs 316B, 318B are eliminated from the tab and instead the tab includes indented portion(s).

Figure 12:
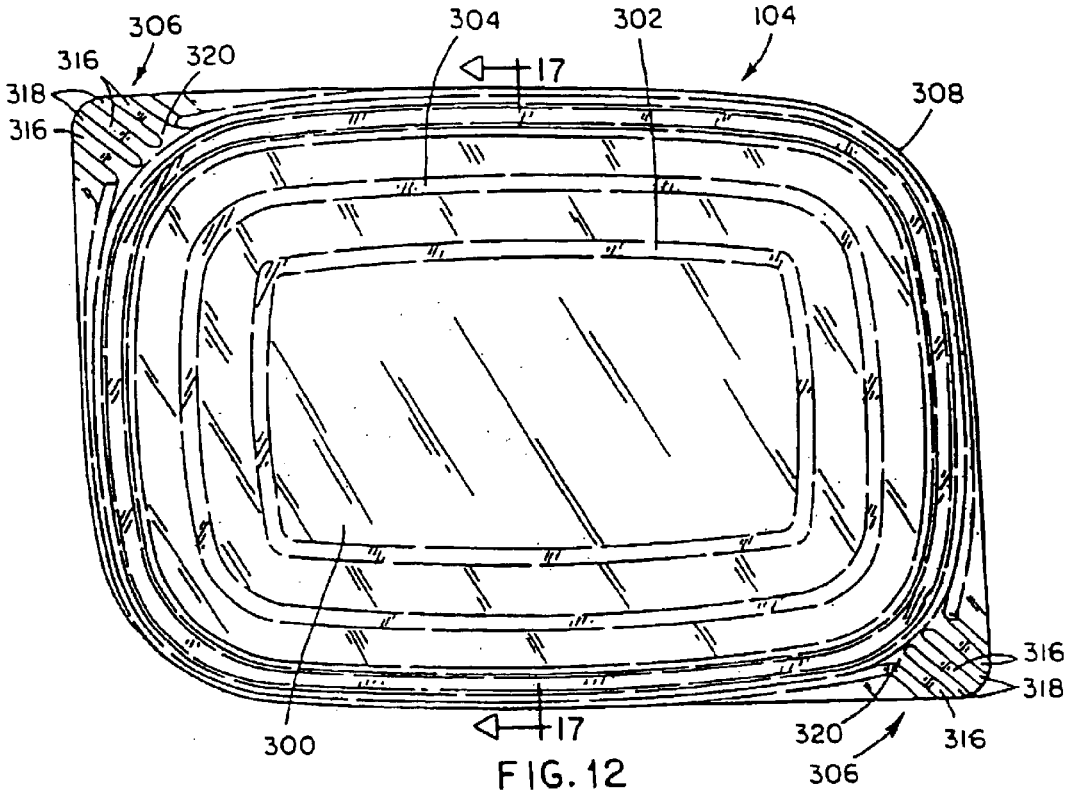
FIG. 12 is a bottom plan view of the container top.
Figure 13:
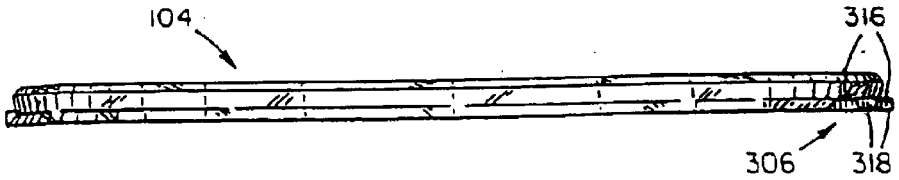
FIG. 13 is a side elevation view of the container top.
Figure 14:
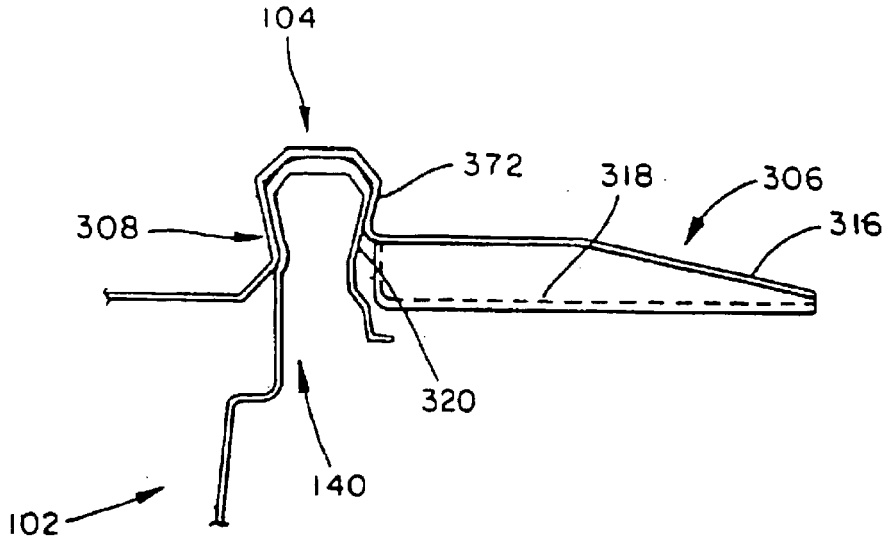
FIG. 14 is a cross-sectional view taken along line 14—14 of FIG. 2.

Referring to FIGS. 11, 12 and 14, the tabs 306 provide a recess 320 in the downwardly and inwardly extending cut-back portion 372 of the closure device 308 adjacent to the base of the tab 306. As a result, the recess 320 provides less interference contact with the container bottom 102 during the removal or engagement of the container top 104 while still providing an adequate cut-back portion to maintain proper sealing of the closure device.

By utilizing the tab 306 and the recess 320, less force is required to remove the container top 104 from the container bottom 102. For example, the force required to close the container top 104 onto the container bottom 102 is approximately 27 pounds. However, the force required to open the container top 104 from the container bottom 102 using the tab 306 is approximately 1.8 pounds. Similarly, the force required to close the container top 604 onto the container bottom 602 in FIGS. 18–31 is approximately 31 pounds and the force required to open using the tab is approximately 1.6 pounds. These forces demonstrate the advantage of the tab and the leverage which the tab provides in opening the container. The lower opening force also reduces the possibility for container failure due to stress and fatigue.

In addition, the lower opening force may be beneficial when the container is used in a freezer. Some materials which may be used to make the container may become brittle at or near freezer temperatures. Consequently, if the container is removed from the freezer and immediately opened, the material for the container (and thus the container) are subject to the failure if the opening force is too high. Therefore, the lower opening force reduces the possibility of failure when the container is removed from the freezer and immediately opened.

The tab recess 320 also permits container venting by allowing the corner of the container top 104 to be removed from the container bottom 102 while still maintaining a seal around the remaining perimeter of the container. This feature is useful in microwave cooking where the container top 104 prevents food from splattering onto the inside surface of the microwave while still allowing the container to vent.

In one embodiment depicted by FIG. 17A, the container top closure device 308 may include an upwardly and inwardly extending lead-in portion 360, an inner vertical sealing portion 362, an upwardly and outwardly extending cut-back portion 364, an upwardly and inwardly extending portion 366, a horizontal surface 368, a downwardly and outwardly extending portion 370, a downwardly and inwardly extending cut-back portion 372, an outer vertical portion 374, a downwardly and outwardly extending lead-in portion 376 and a substantially horizontal lip 378. The terms "inner" and "outer" are used with respect to the reference line 381 shown in FIG. 17A. The terms "inwardly" and "outwardly" are used with respect to the reference line 381 and moving in a clockwise direction 383 as shown in FIG. 17A.

FIG. 17B illustrates the container top closure device 308 shown in FIG. 17A of the present invention. The representative dimensions of the various parameters are given as follows:

| PARAMETER | FIRST RANGE | SECOND RANGE | PREFERRED |
|---|---|---|---|
| 500 | 10–80 degrees | 25–65 degrees | 45 degrees |
| 502 | 5–20 degrees | 8–16 degrees | 15 degrees |
| 504 | 5–20 degrees | 8–16 degrees | 15 degrees |
| 506 | 10–80 degrees | 25–65 degrees | 45 degrees |
| 508 | 140–1124 mils | — | 281 mils |
| 510 | 135–1084 mils | — | 271 mils |
| 512 | 103–828 mils | — | 207 mils |
| 514 | 101–812 mils | — | 203 mils |

-continued

| PARAMETER | FIRST RANGE | SECOND RANGE | PREFERRED |
|---|---|---|---|
| 516 | 134–676 mils | — | 169 mils |
| 518 | 120–644 mils | — | 161 mils |
| 520 | 28–228 mils | — | 57 mils |
| 522 | 24–196 mils | — | 49 mils |
| 524 | 10–80 degrees | 25–65 degrees | 45 degrees |
| 526 | 10–80 degrees | 25–65 degrees | 45 degrees |
| 528 | 172–1380 mils | — | 345 mils |
| 530 | 157–1260 mils | — | 315 mils |
| 532 | 134–1076 mils | — | 269 mils |
| 534 | 130–1044 mils | — | 261 mils |
| 536 | 120–960 mils | — | 240 mils |
| 538 | 50–404 mils | — | 101 mils |
| 540 | 34–276 mils | — | 69 mils |
| 542 | 18–144 mils | — | 36 mils |

As shown in FIG. 17D, when container tops 104 are stacked together in a nested formation, the closure device 308 of the upper container top 104 rests upon the closure device 308 of the lower container top 104. More specifically, the lead-in portions 360, 376 of the upper container top 104 rest upon the upwardly and inwardly extending portion 366 and the downwardly and outwardly extending portion 370 of the lower container top 104 respectively. The portions in contact 360, 366, 370, 376 prevent the container tops 104 from interlocking as well as provide horizontal support for retaining the nested stack in a secure position.

As shown in FIG. 17C, the closure device 308 of the container top 104 is engaged with the closure device 140 of the container bottom 102. The closure devices are engaged by positioning the lead-in portions 360, 376 of the container top over the lead-in portions 154, 158 of the container bottom. A vertical force is then applied to the container top 104 to overcome the interference between the closure devices 140, 308. The cut-back portions 364, 372 of the thinner container top 104 deflect horizontally while passing over the lead-in portions 154, 158 of the container bottom 102. Once beyond the lead-in portions 154, 158 of the container bottom 102, the cut-back portions 364, 372 of the container top 104 retract inwardly against the cut-back portions of the container bottom 152, 160. The retracting forces of the cut-back portions 364, 372 of the container top 104 cause the container top 104 to move downwardly until the horizontal surface 368 of the container top 104 rests against the horizontal rim surface 156 of the container bottom 102. In addition, the force created by the expanded cut-back portions 364, 372 causes the container top 104 to audibly snap into place, indicating that the container is securely closed. In the engaged position, as shown in FIG. 17C, the cut-back portion 364 of the container top 104 is still deflected from its relaxed position. Thus, the cut-back portion 364 exerts a force against the inner sealing wall 150 of the container bottom 102 and forms a seal 402.

The container top 104 is also designed slightly larger than the container bottom 102. This difference in size forms an interference fit between the cut-back portion 364 of the container top 104 and the inner sealing wall 150 of the container bottom 102. In one embodiment, the range of interference fit is 5 to 80 mils. As a result, when the two pieces are engaged, a strong inside seal 402 is formed around the inside perimeter of the container. Due to variations resulting from the thermoforming process and the polypropylene material, it is beneficial to have additional sealing points. Thus, the closure devices may have several other sealing areas when the container top engages the container bottom. Referring to FIG. 17C, a second seal 404 may occur where the inwardly extending portion 366 engages the lead-in portion 154, a third seal 406 may occur where the horizontal surface 368 engages the horizontal rim surface 156, a fourth seal 408 may occur where the outwardly extending portion 370 engages the lead-in portion 158 and a fifth seal 410 may occur where the cut-back portion 372 engages the cut back portion 160.

Both the container bottom 102 and the container top 104 may be made of a plastic material. More particularly, the top and bottom may be fabricated by thermoforming a clarified polypropylene homopolymer material. In one embodiment, the container is made from clarified polyprohomo with the trade name 3289M and sold by Fina Oil and Chemical Co. which has the following properties:

| Resin Properties | Typical Value | ASTM Method |
|---|---|---|
| Melt Flow, g/10 min. | 1.8 | D-1238 Condition "L" |
| Density, g/cc | 0.905 | D-1505 |
| Melting Point, ° F. | 330 | DSC |
| ° C. | 165 | |

| Mechanical Properties | Typical Value | ASTM Method |
|---|---|---|
| Tensile, psi | 5,200 | D-638 |
| MPa | 35.9 | |
| Elongation, % | 10.0 | D-638 |
| Tensile Modulus, psi | 240,000 | D-638 |
| MPa | 1,655 | |
| Flexural Modulus, psi | 210,000 | D-790 |
| MPa | 1,450 | |
| Izod Impact @ 73° F. | | D-256A |
| Notched-ft.lb./in. | 0.8 | |
| J/m | 40.0 | |

| Thermal Properties | Typical Value | ASTM Method |
|---|---|---|
| Heat Deflection | | D-648 |
| ° F. at 66 psi | 240 | |
| ° C. at 4.64 kg/cm$^2$ | 115 | |

| Barrier Properties | Typical Value | ASTM Method |
|---|---|---|
| Moisture Vapor Transmission @ 100° F.(38°), 90% R.H. gms/mil/100 in.$^2$/24 hrs. | 0.45 | E-96 |
| Oxygen Transmission, @ 73° F.(23° C.) cc/100 in$^2$ mil/24 hrs./atm. | 240 | D-1434 |

In another embodiment, the container may be fabricated by thermoforming a clarified random copolyer polypropylene material, such as Pro-fax SR-256M from Montell North America Inc., Wilmington, Del., which has the following properties:

| Resin Properties | Typical Value | ASTM Method |
|---|---|---|
| Melt Flow Rate, dg/min | 2 | D 1238 |
| Density, g/cm$^2$ | 0.90 | D 792B |
| Tensile Strength at Yield, psi (MPa) | 4,000 (28) | D 638 |
| Elongation at Yield, % | 13 | D 638 |
| Flexural Modulus, 0.05 in/min, 1% Secant, Kpsi (MPa) | 130 (900) | D 790A |
| Flexural Modulus, 0.5 in/min, 1% Secant, Kpsi (MPa) | 135 (930) | D 790B |
| Rockwell Hardness, R Scale | 69 | D 785A |
| Deflection Temperature, ° F.(° C.) at 66 psi (455 kPa) | 174 (79) | D 648 |
| Notched Izon Impact Strength, ft-lbs/in. (J/m) at 73° F. (23° C.) | 6.0 (320) | D 256A |
| Melting Point ° F. | 302 | DSC |
| ° C. | 150 | |

Furthermore, if the material is transparent or semi-transparent, it permits satisfactory visibility of the container contents.

Alternative plastic materials which would be suitable for fabricating the container by thermoforming include PS (polystyrene), CPET (crystalline polethylene terephthalate), APET (amorphous polethylene terephthalate), HDPE (high density polyethylene), PVC polyvinyl chloride), and PC (polycarbonate). A disadvantage of PS and APET is that their limited heat resistance makes these materials unsuitable for microwave cooking. A disadvantage of HDPE is lack of see-through clarity though this material is readily recyclable by current waste handling practices. A disadvantage of CPET is that it lacks see-through clarity though its heat resistance is suitable for convection oven use. Fabrication using PC will yield a container with enhanced functional performance over PP (polypropylene) except that its cost may be prohibitive for a limited, re-use disposable product.

The container bottom 102 is formed from a starting sheet thickness in the range of 15 to 120 mils and preferably 25–40 mils. In one embodiment, the container bottom 102 is formed from a starting sheet thickness of approximately 40 mils. Referring to FIG. 16, the wall thickness of the container bottom will vary due to the thermoforming process. The representative dimensions of various locations for different starting sheet thicknesses are given as follows:

| Parameter | Dimension for 40 mils Starting Sheet | Dimension for 25 mils Starting Sheet |
|---|---|---|
| 560 | 17–21 | 10–13 |
| 562 | 33–37 | 21–23 |
| 564 | 20–26 | 12–16 |
| 566 | 12–17 | 8–11 |
| 568 | 8–10 | 5–6 |
| 570 | 16–18 | 10–11 |
| 572 | 9–11 | 6–7 |
| 574 | 23–31 | 14–19 |

The container bottom 102 has a sufficient thickness to withstand the heat of microwave cooking and remain sturdy during lifting while laden with hot food and also withstand the heat of top-shelf dishwashing without deforming.

The container top 104 is formed from a starting sheet thickness in the range of 7 to 60 mils and preferably 12–18 mils. In one embodiment, the container top is formed from a starting sheet thickness of approximately 15 mils. Referring to FIG. 17, the wall thickness of the container top will vary due to the thermoforming process. The representative dimensions of various locations for different starting thicknesses are given as follows:

| Parameter | Dimension for 15 mils Starting Sheet | Dimension for 12 mils Starting Sheet |
|---|---|---|
| 580 | 8–12 | 6–10 |
| 582 | 14–15 | 11–12 |
| 584 | 8–11 | 6–9 |
| 586 | 6–8 | 5–6 |
| 588 | 14–15 | 11–12 |

The thinner container top reduces material costs and increases flexibility to more easily accommodate its removal from and engagement onto the container bottom. The container top 104 will maintain adequate flexibility for proper sealing even during typical freezer temperatures. Furthermore, the lack of surface detail in the container material provides for easy washing. The size of the container 100 as depicted in FIGS. 1 through 5 is approximately 6 inches in length, 5 inches in width and 2.5 inches in height.

Figure 17F:
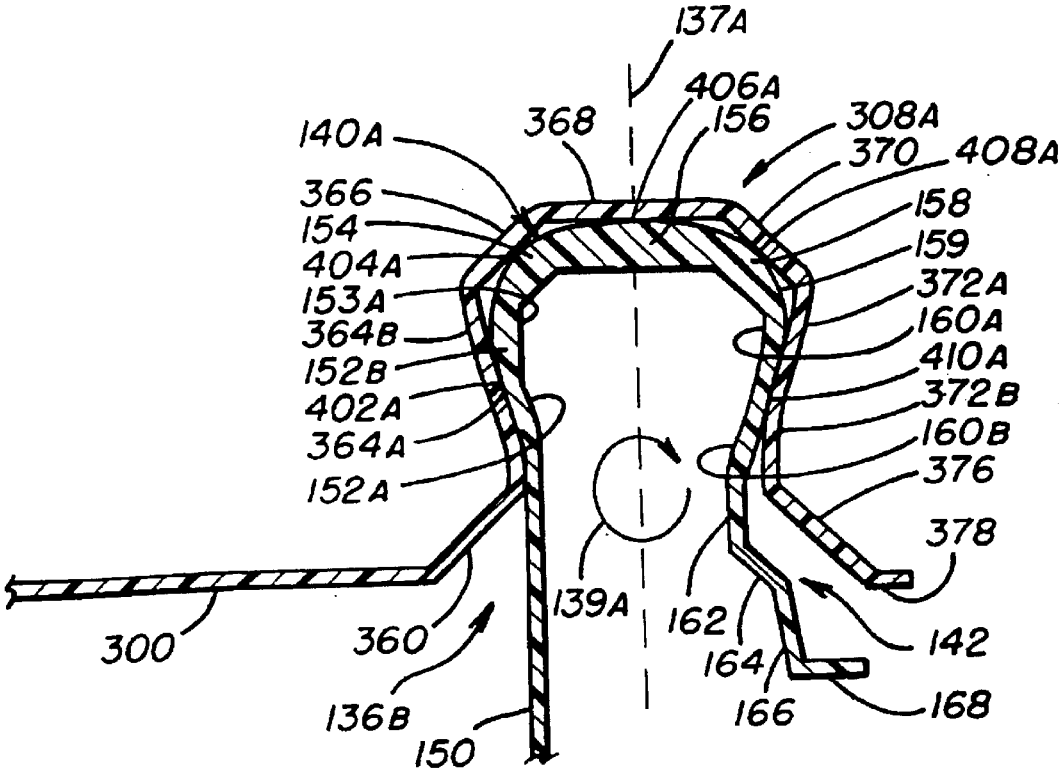
FIG. 17F is a cross section view similar to FIG. 17C showing an engaged position between the respective closure devices of a container top and bottom constructed in accordance with another embodiment of the present invention.
Figure 18:
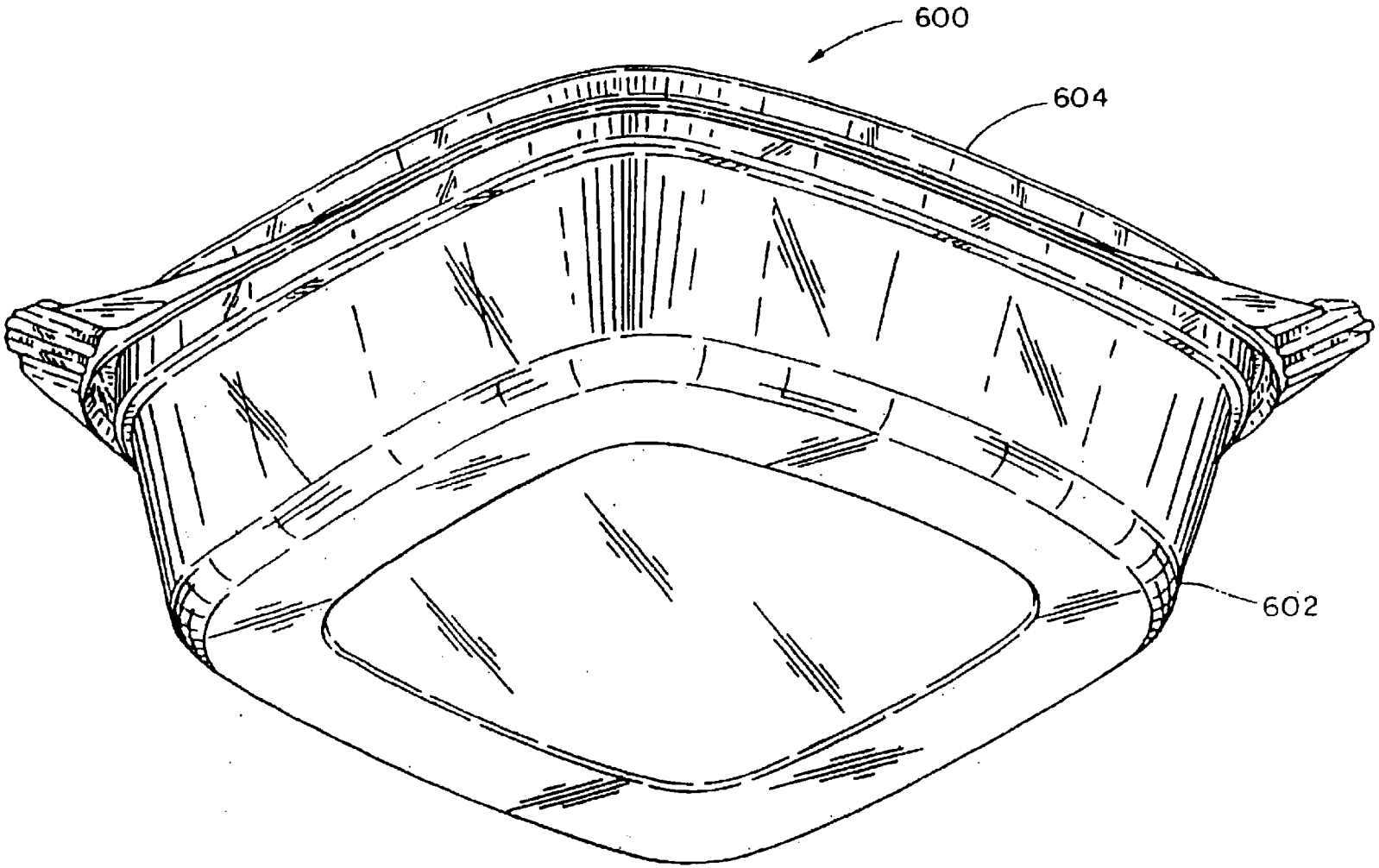
Figure 19:
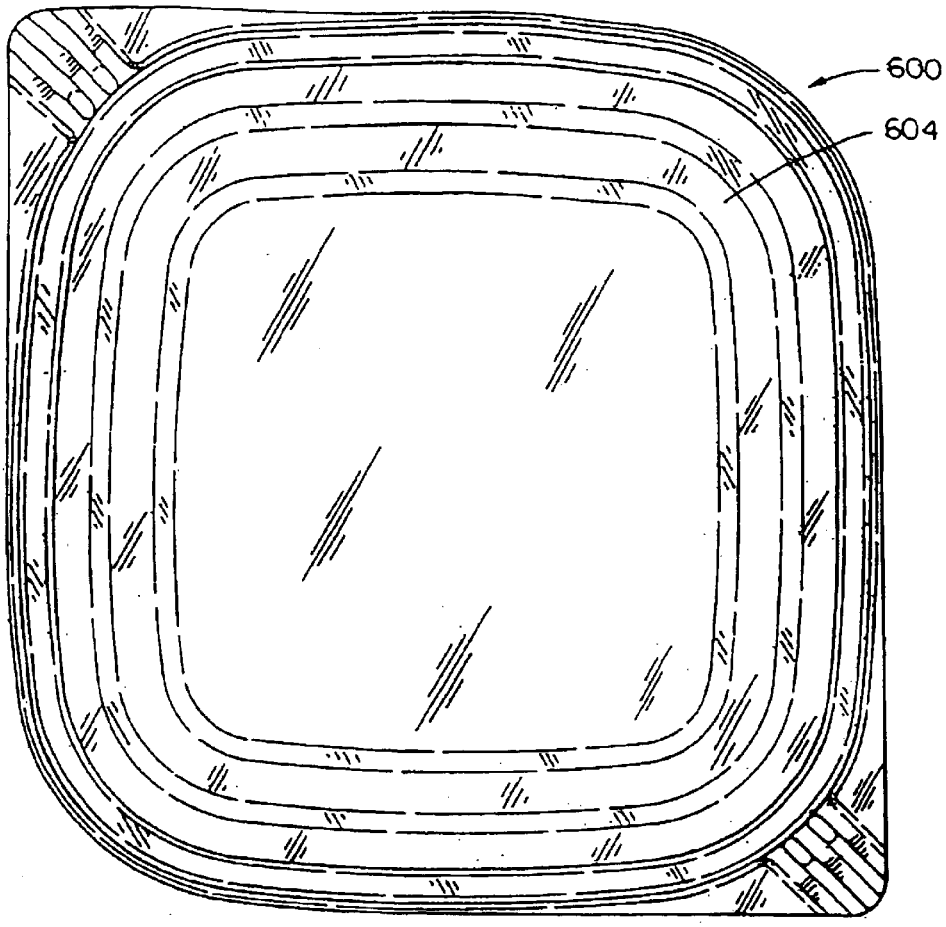
FIG. 19 is a top plan view of the container in FIG. 18.
Figure 20:
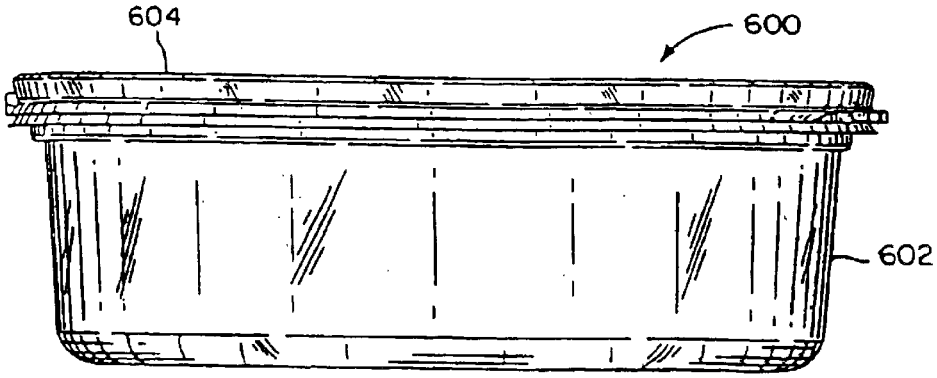
FIG. 20 is a side elevation view of the container in FIG. 18.
Figure 21:
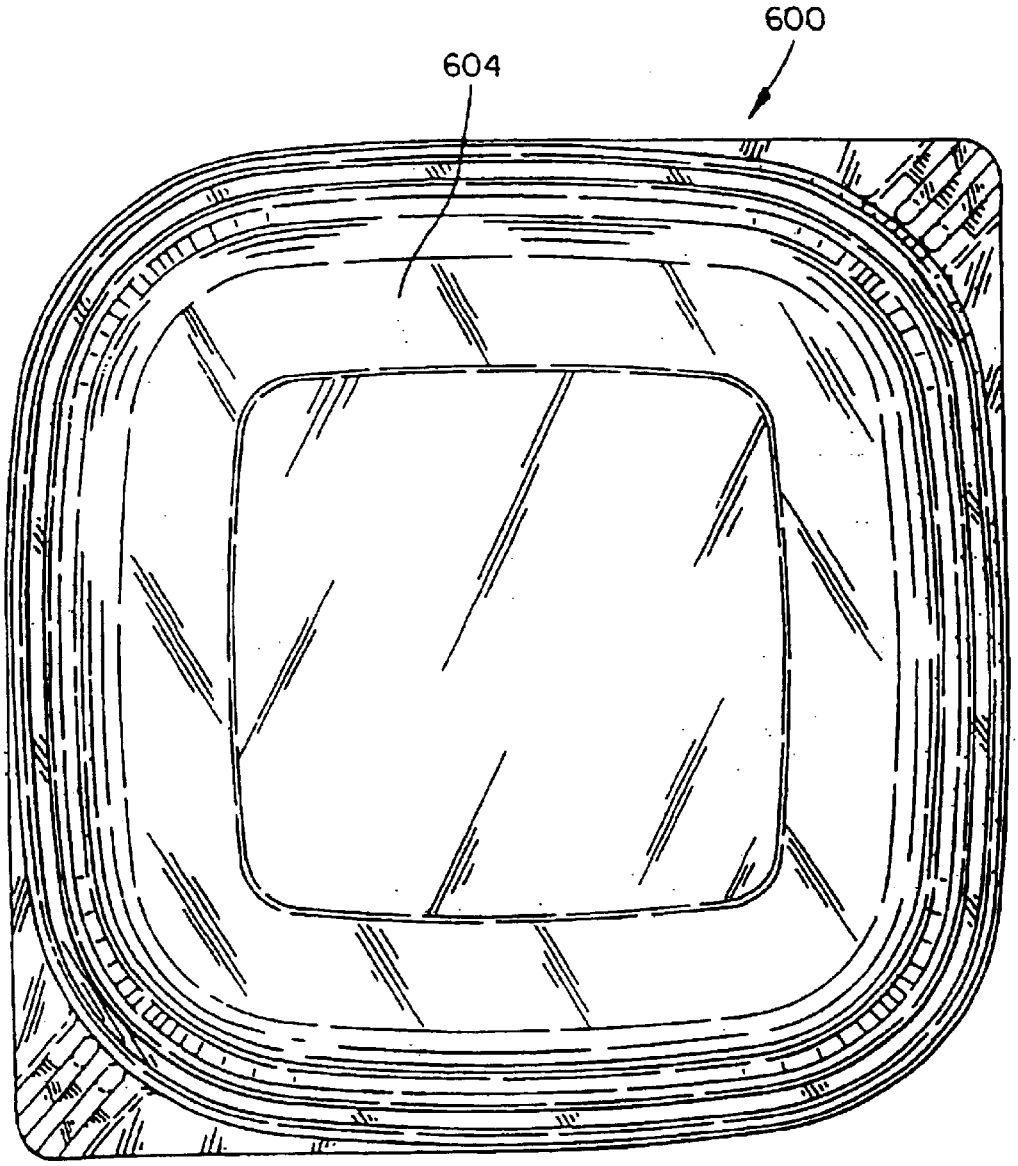
FIG. 21 is a bottom plan view of the container in FIG. 18.
Figure 22:
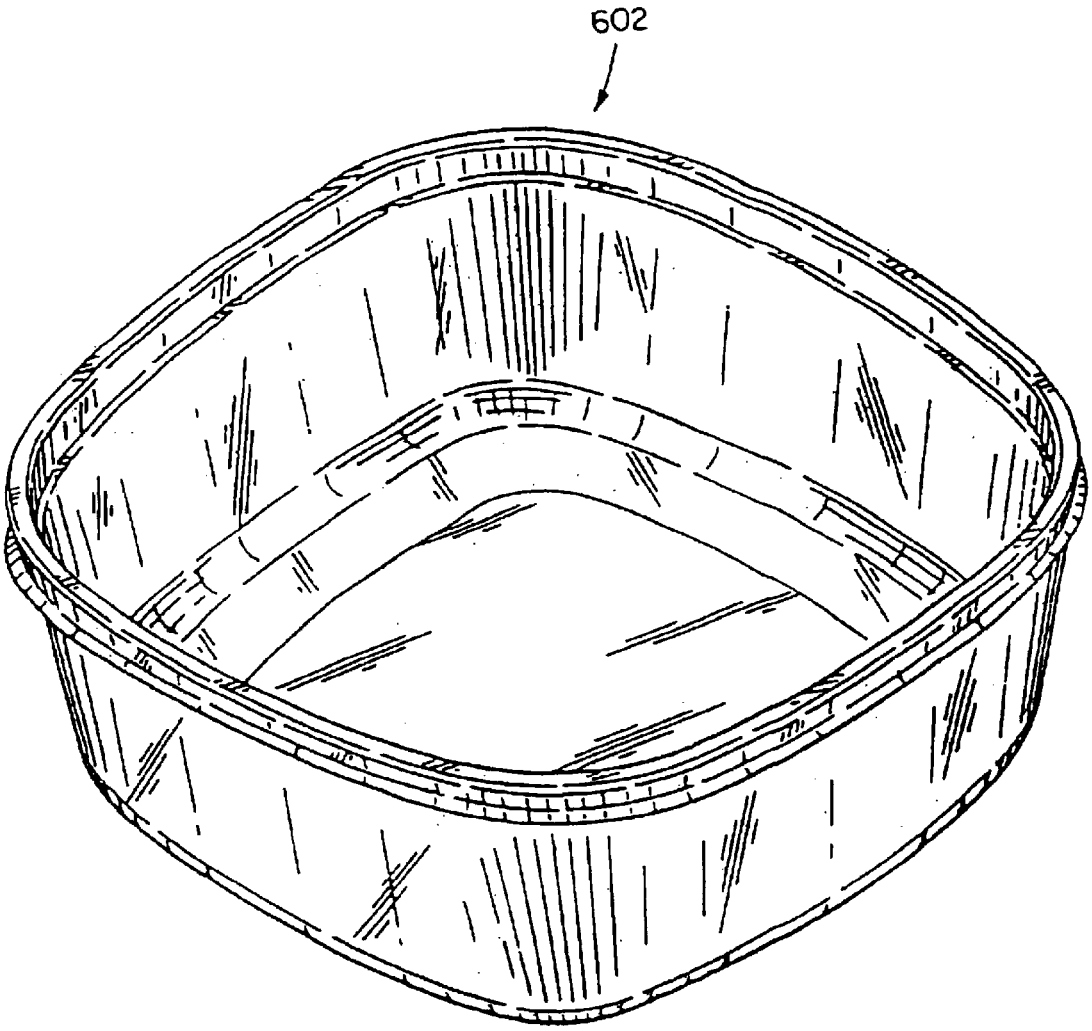
FIG. 22 is a perspective view of the container bottom in FIG. 18.
Figure 23:
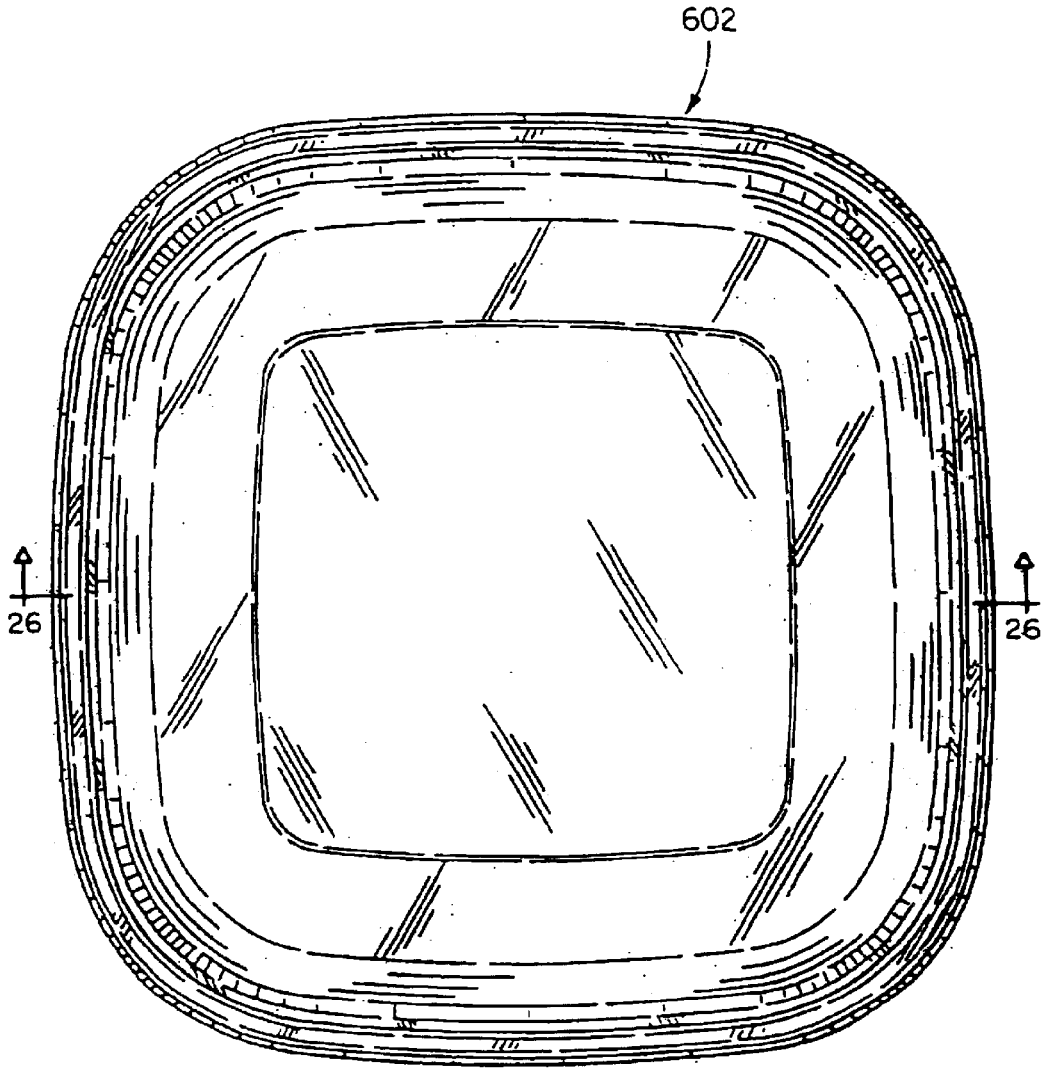
FIG. 23 is a top plan view of the container bottom in FIG. 22.
Figure 24:
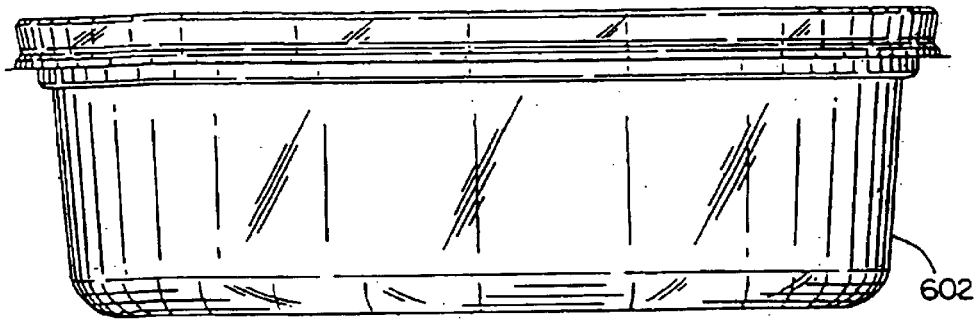
FIG. 24 is a side elevation view of the container bottom in FIG. 22.

FIG. 17F shows the engaged position between the respective closure devices 136B and 308A of the container bottom 102 and container top 104 constructed in accordance with another embodiment of the present invention.

The closure device 136B shares many of the same features as the closure devices 136 and 136A shown in FIGS. 16A and 16C, respectively, and structural elements common to all embodiments are indicated by the same reference numerals. Referring to FIG. 17F, the closure device 136B comprises an inner vertical sealing wall 150, a retention bead 140A, an outer vertical wall 162 and a skirt 142. The terms "inner" and "outer" are used with respect to the reference line 137 shown in FIG. 16A. The terms "inwardly" and "outwardly" are used with respect to the reference line 137A and moving in a clockwise direction 139A as shown in FIG. 17F.

The vertical sealing wall 150 extends from a denesting shoulder (not shown) and merges into the retention bead 140A. The retention bead 140A includes an inner cutback portion of generally S shape configuration defined by a pair of arc segments 152A and 152B, an inner vertical portion 153A, an upwardly and inwardly extending lead-in portion 154, a horizontal rim surface 156, a downwardly and outwardly extending lead-in portion 158, an outer vertical portion 159, and an outer cut-back portion of generally S shaped configuration defined by arc segments 160A and 160B.

The outer vertical wall 162 joins the retention bead 140 and the skirt 142. The skirt 142 may include a first downwardly and outwardly extending portion 164, a second downwardly and outwardly extending portion 166 of a more vertical position than the first portion 164, and a substantially horizontal lip 168.

The container top closure device 308A include an upwardly and inwardly extending lead-in portion 360, an inner cut-back portion of generally S shaped configuration defined by arc segments 364A and 364B, an upwardly and inwardly extending portion 366, a horizontal surface 368, a downwardly and outwardly extending portion 370, an outer cut-back portion of generally S shaped configuration defined by arc segments 372A and 372B, a downwardly and outwardly extending lead-in portion 376 and a substantially horizontal lip 378. The terms "inner" and "outer" are used with respect to the reference line 137A shown in FIG. 17F. The terms "inwardly" and "outwardly" are used with respect to the reference line 137A and moving in a clockwise direction 139A as shown in FIG. 17F.

As shown in FIG. 17F, the closure device 308A of the container top 104 is engaged with the closure device 140A of the container bottom 102. The closure devices are engaged by positioning the lead-in portions 360, 376 of the container top over the lead-in portions 154, 158 of the container bottom. A vertical force is then applied to the container top 104 to overcome the interference between the closure devices 140A, 308A. The inner and outer cut-back portions of the thinner container top 104 deflect horizontally while passing over the lead-in portions 154, 158 of the container bottom 102. Once beyond the lead-in portions 154, 158 of the container bottom 102, the arc segment pairs 364A, 364B and 372A, 372B defining the respective inner and outer cut-back portion of the container top 104 retract inwardly against the corresponding arc segment pairs 152A, 152B and 160A, 160B defining the inner and outer cut-back portions of the container bottom. The retracting forces of the inner and outer cut-back portions of the container top 104 cause the container top 104 to move downwardly until the horizontal surface 368 of the container top 104 rests against the horizontal rim surface 156 of the container bottom 102. In addition, the force created by the expanded cut-back portions causes the container top 104 to audibly snap into place, indicating that the container is securely closed. In the engaged position, as shown in FIG. 17F, the arc segment pair 364A, 364B defining the inner cut-back portion of the container top 104 is still deflected from its relaxed position. Thus, the inner cut-back portion exerts a force against the inner sealing wall 150 of the container bottom 102 and forms a seal 402A. The engaged surfaces of the respective mating cut-back portions of the container top and bottom are located in substantially the same horizontal plane. The closure is not likely to rotate due to symmetry about the vertical midline.

As described above, the closure devices may also have several other sealing areas when the container top engages the container bottom. For example, a second seal 404A may occur where the inwardly extending portion 366 engages the lead-in portion 154, a third seal 406A may occur where the horizontal surface 368 engages the horizontal rim surface 156, a fourth seal 408A may occur where the outwardly extending portion 370 engages the lead-in portion 158 and a fifth seal 410A may occur where the arc segment pair 372A, 372B defining the container top outer cut-back portion engages the arc segment pair 160A, 160B defining the container bottom outer cut back portion.

The contact points which generate the desired continuous inside and outside seals (i.e., first seal 402A and fifth seal 410A) may be comprised of (1) matching arc segments on the container top and bottom that align concentrically or (2) adjacent arc segments on the container top and bottom that may not align concentrically due to non-ideal alignment but nonetheless contact each other tangentially owing to design interference and the resiliency of material selected.

Under certain conditions, the arc segments of the FIG. 17F embodiment may provide a benefit over the use of linear segments such as, for example, in the case where non-ideal alignment of linear segments results in skewed contact surfaces and wider gaps over greater non-contacting surface areas.

Additional embodiments for the configuration of the inner and outer cut-back portions may include, but are not limited to, a combination of linear and arc segments, a plurality of arc segments, and use of single arc segments.

FIGS. 18–31 illustrate another embodiment of the present invention similar to that described in FIGS. 1–17E except that the container is of a different size. The container 600 consists of a container bottom 602 and a container top 604. The container 600 is approximately 6.5 inches in length, 6.5 inches in width and 2 inches in height.

Figure 26:
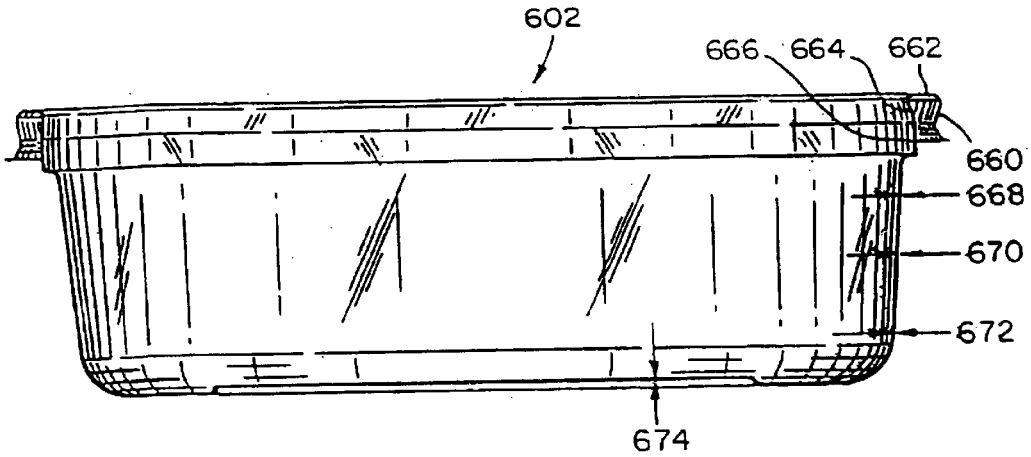
FIG. 26 is a cross-sectional view of the container bottom taken along line 26—26 of FIG. 23.
Figure 25:
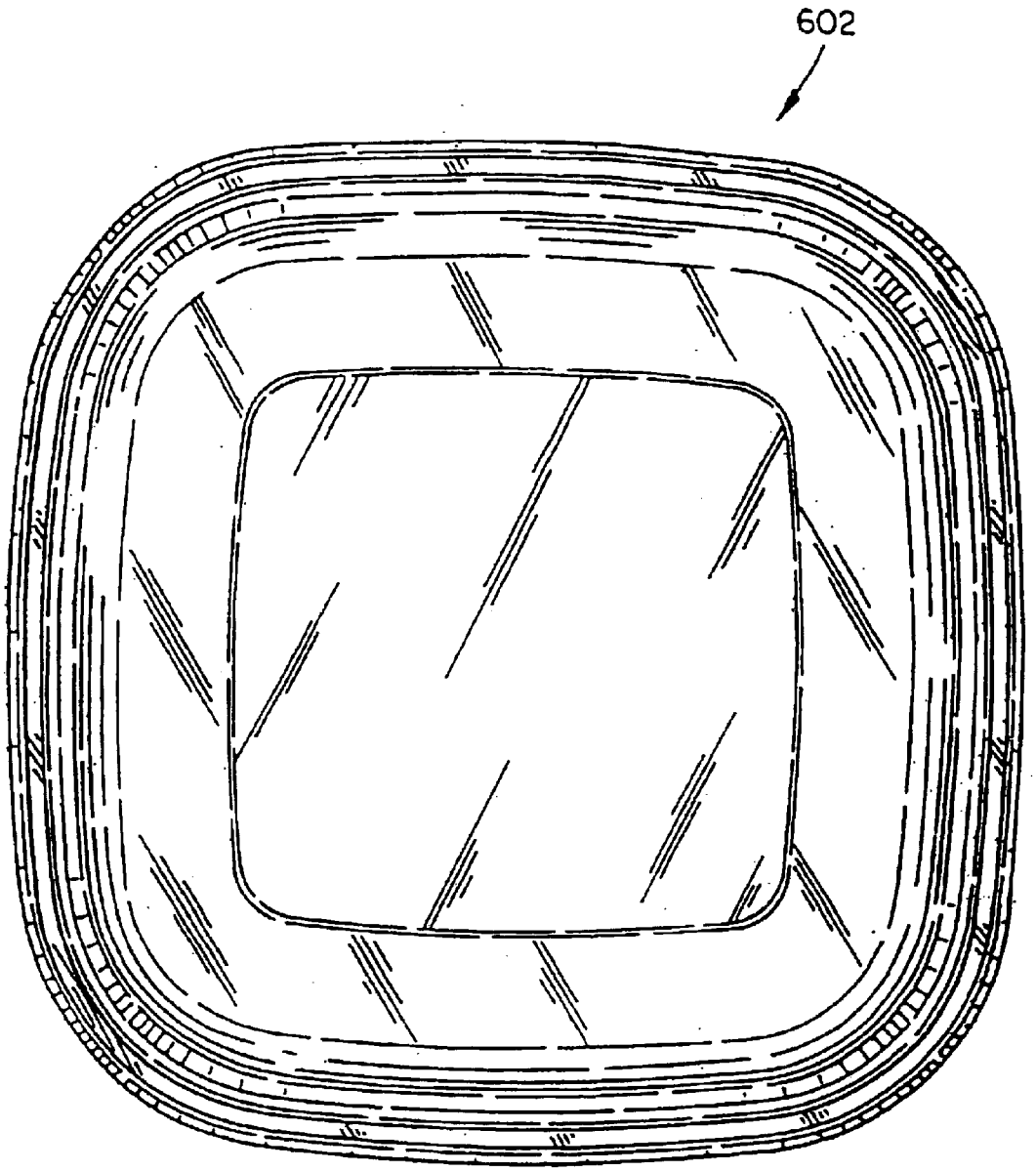
FIG. 25 is a bottom plan view of the container bottom in FIG. 22.
Figure 27:
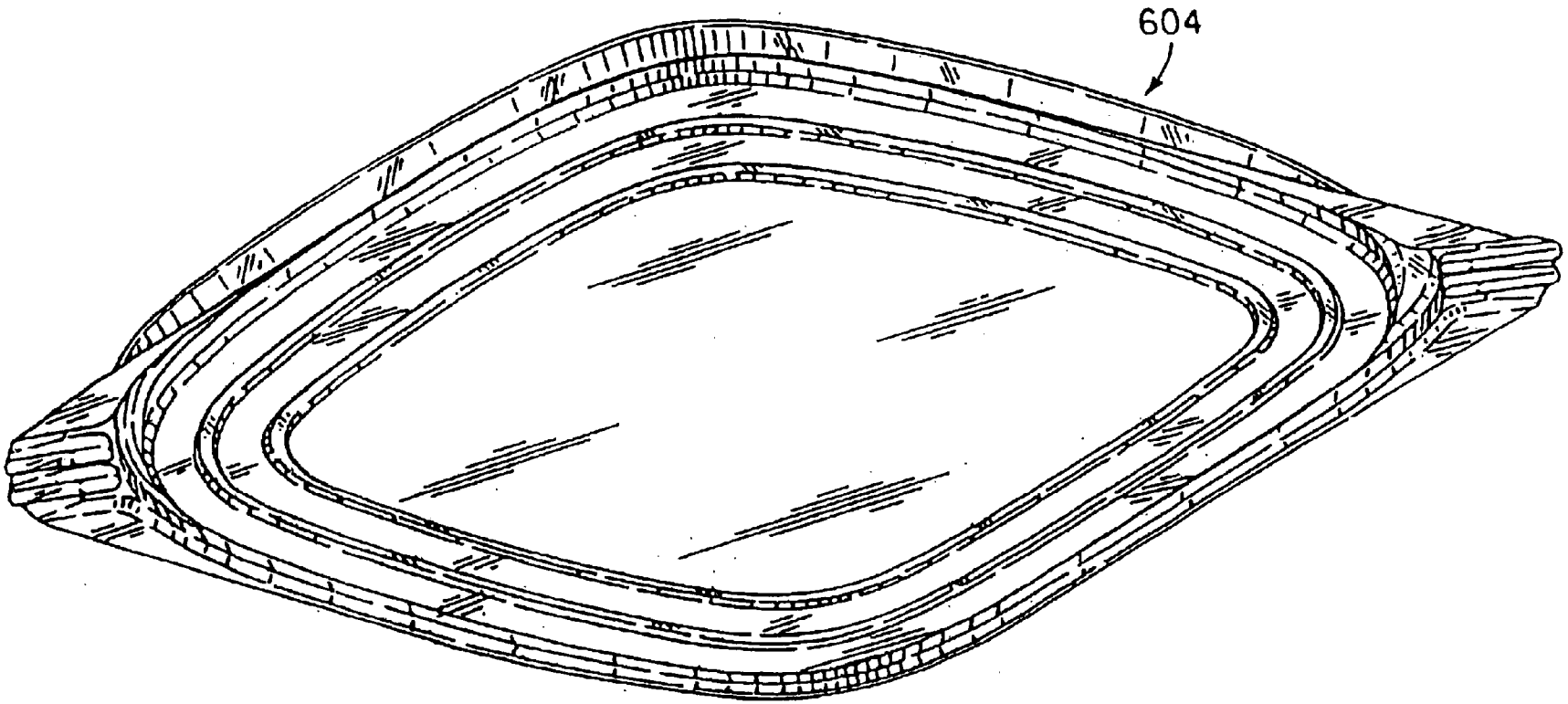
FIG. 27 is a bottom perspective view of the container top in FIG. 18.
Figure 28:
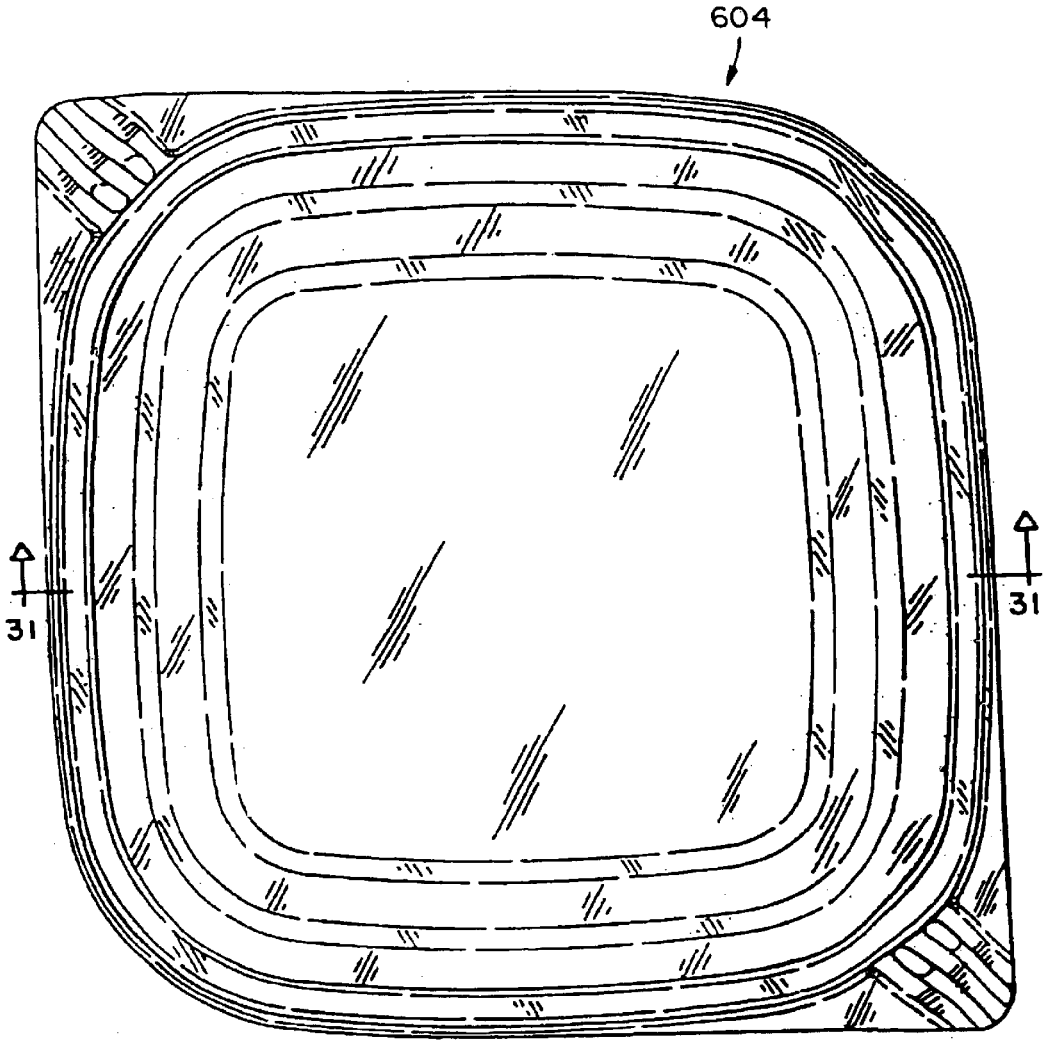
FIG. 28 is a bottom plan view of the container top in FIG. 27.
Figure 29:
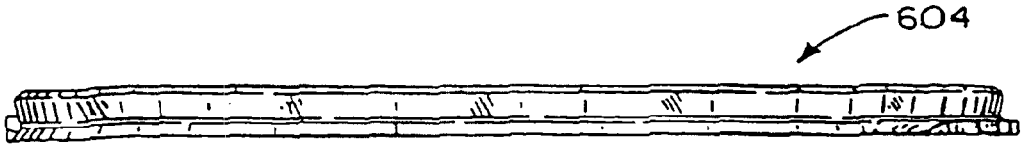
FIG. 29 is a side elevation view of the container top in FIG. 27.
Figure 31:
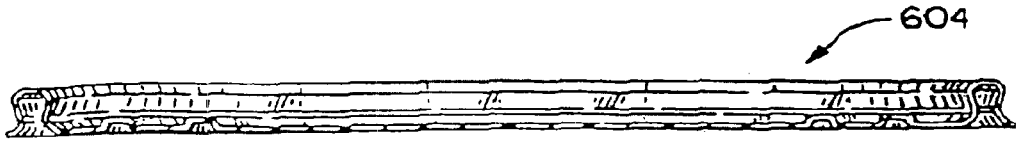
FIG. 31 is a cross-sectional view of the container top taken along line 31—31 of FIG. 28.
Figure 30:
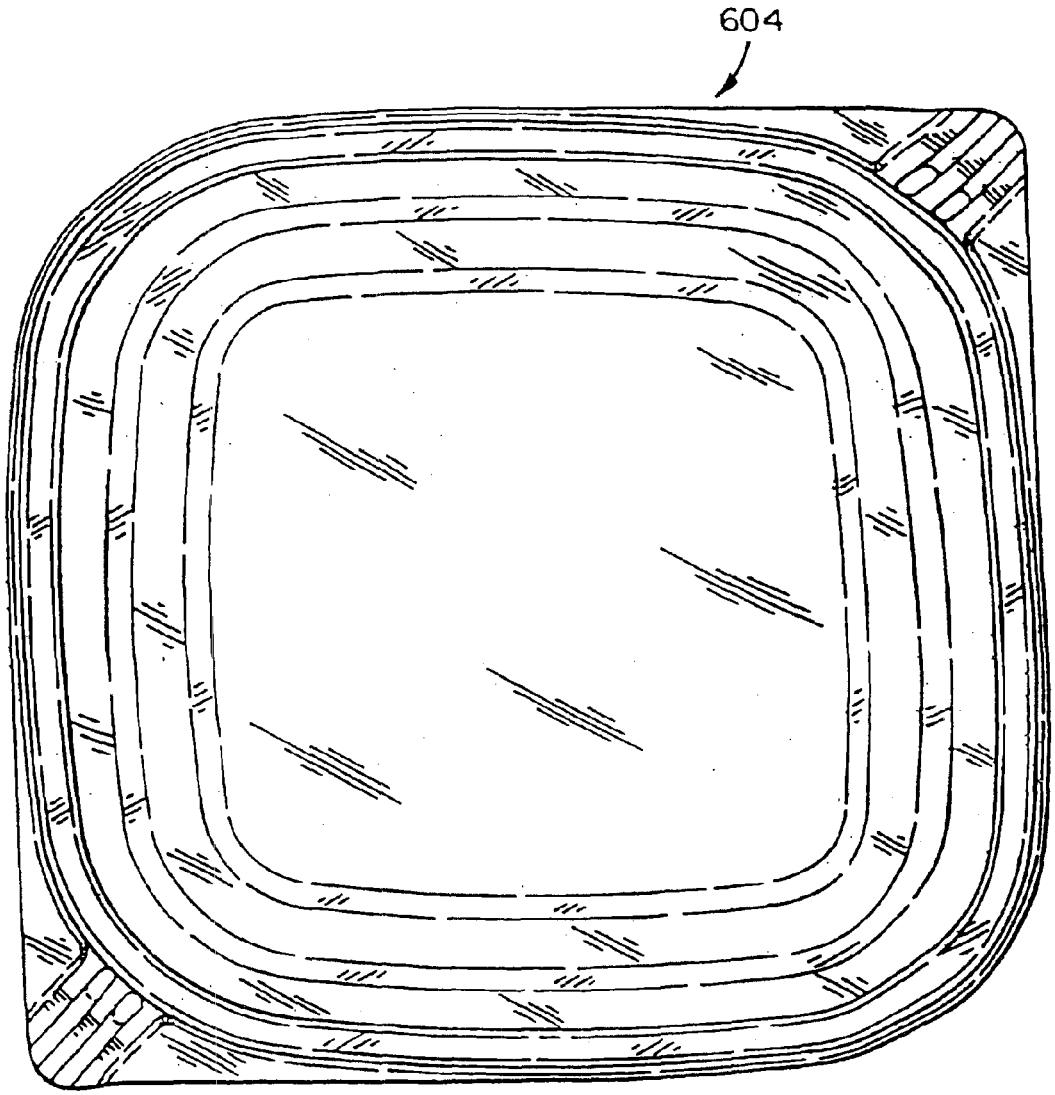
FIG. 30 is a top plan view of the container top in FIG. 27.
Figure 32:
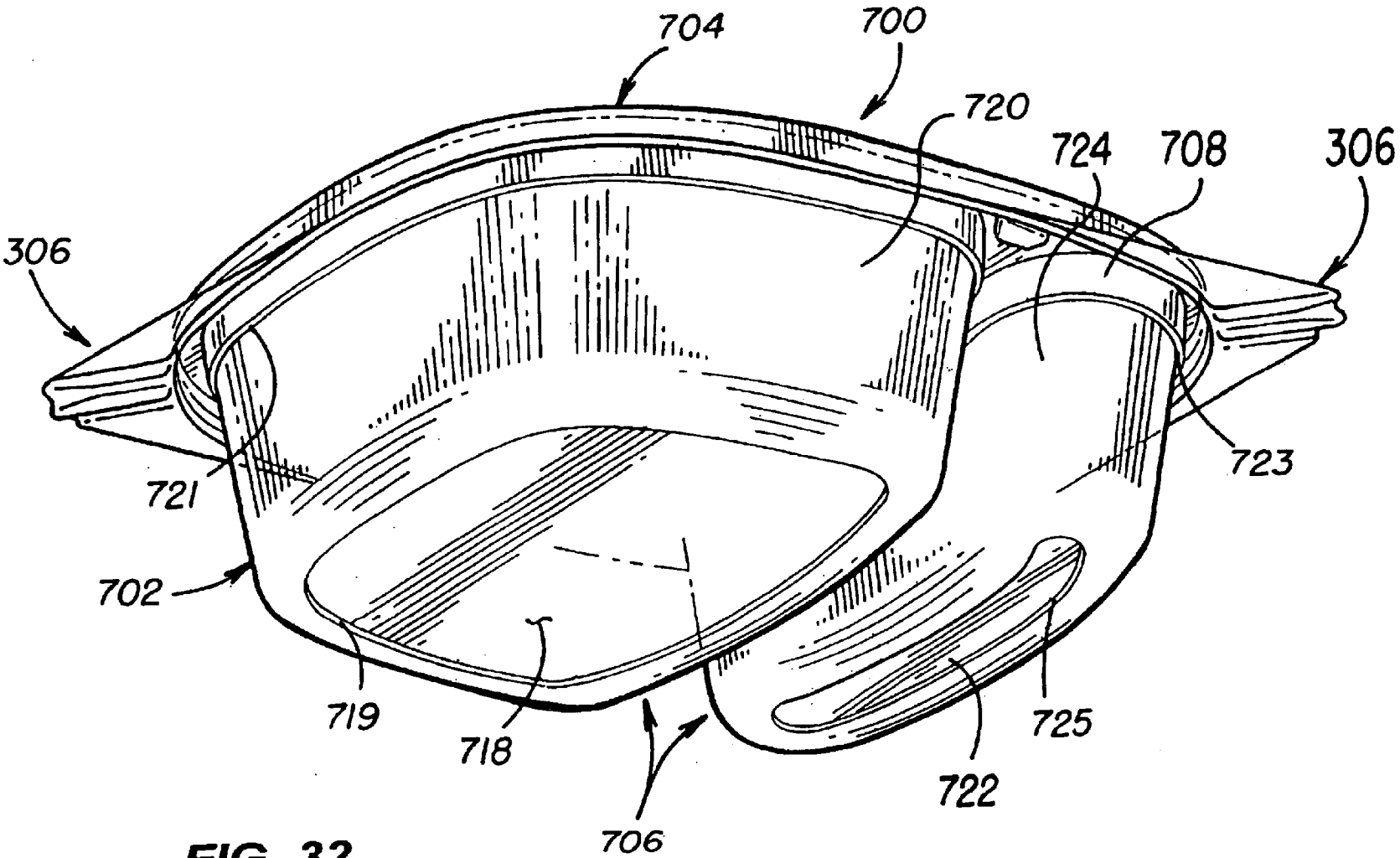

The container bottom 602 is formed from a starting sheet thickness in the range of 18 to 140 mils and preferably 22–35 mils. In one embodiment, the container bottom 602 is formed from a starting sheet thickness of approximately 35 mils. Referring to FIG. 26, the wall thickness of the container bottom 602 will vary due to the thermoforming process. The representative dimensions of various locations for different starting sheet thickness are given as follows:

| Parameter | Dimension for 40 mils Starting Sheet | Dimension for 35 mils Starting Sheet |
|---|---|---|
| 660 | 16–22 | 14–19 |
| 662 | 33–44 | 29–35 |
| 664 | 18–40 | 16–35 |
| 666 | 15–35 | 13–31 |
| 668 | 12–19 | 11–17 |
| 670 | 16–26 | 14–23 |
| 672 | 12–18 | 11–16 |
| 674 | 25–31 | 22–27 |

The container top 604 is similar to the container top 104 except the overall size corresponds to container bottom 602. Specifically, the dimensional parameters including the starting sheet thicknesses and the finished wall thicknesses are the same as for the container top 104 noted above.

The weight to volume ratio (i.e., the weight of the container over the volume of the container) for the container 100 shown in FIGS. 1–17 is approximately 33.8 grams/liter for the total of the top and bottom of the container. The weight to volume ratio for the container 600 shown in FIGS. 18–31 is approximately 50.7 grams/liter for the total of the top and bottom of the container.

The container may include additional features. For example, the container top and/or the container bottom may have an area which allows the user to write information, such as, the date. The write-on area could be an opaque color, such as, an opaque white, which would receive a contrasting color from a writing instrument, such as, a marker with black ink. The write-on area could be incorporated into the material for the container or could be applied to the material, such as, by printing.

Another feature which can be included on the container are volume marks. The container bottom can have marks on the side of the container indicating a specific volume, such as, ounces, pints, cups, or milliliters. For example, the marks may indicate one ounce, two ounces, etc. and include the appropriate text. The marks may be formed into the material or the marks may be applied to the material, such as, by printing.

The container may also include a visual indication of closure between the container top and the container bottom. The visual indication may be a color change in the area where the container top engages the container bottom. In one embodiment, the closure device on the container top may be a first color, such as, a translucent blue and the closure device on the container bottom may be a second color, such as, an opaque yellow. When the closure devices are occluded, the first and second colors produce a third color, such as, a green which is visible to the user to indicate that the container is sealed. Alternatively, the color change can result from the appearance or loss of a color as a result of hindrance by the closure portions. Examples of color change closures and techniques for forming a color change seal are shown in U.S. Pat. Nos. 4,186,786, 4,285,105, 4,829,641, 4,907,321, 5,248,201, 5,356,222, 5,252,281 and 5,427,266 which are incorporated herein by reference.

The colors may be incorporated into the material for the container or a portion of the container, such as in the closure area, or the colors may be applied to the material, such as, by printing. The actual inclusion of a color change closure or visual indication closure can be effected by use of established commercially available techniques. For example, if the lid and tub are to have a different color at the interface where the lid attaches to the tub the two respective surfaces can be fashioned with a color or design by use of screen printing (also known as silk-screen printing), pad printing (also known as transfer pad printing)or ink jet printing. The printing may be performed on the unformed material or the printing may be performed on the formed container. In addition, other approaches for forming a color or pattern on the lid and tub surfaces where such mate includes the use of coextruded sheet material which is then thermoformed. The aforementioned techniques are well known for use in providing decorative surfaces to plastic surfaces.

Furthermore, the colors may be incorporated into the material by using in-mold labeling during the thermoforming process. The process for in-mold labeling for thermoforming involves the following steps. The label, such as an opaque yellow label, is positioned in a predetermined location on the thermoforming cavity for the part. The plastic is then positioned over the label and over the thermoforming cavity. The part is then formed and the label is embedded into the part. As an example, the closure device on the container top may include a translucent blue in-mold label and the closure device on the container bottom may be an opaque yellow in-mold label. When the closure devices are occluded, the in-mold labels produce green which is visible to the user to indicate that the container is sealed.

The container may also include an audible indication of closure or a tactile indication of closure. In one embodiment, the closure device on the container top includes interior protrusions which engage exterior detents on the closure device on the container bottom. When the closure devices are engaging, the closure devices will make a clicking sound and cause a vibration in the container which is perceptible to the user to indicate that the container is sealed. Examples of audible closures and/or tactile closures disclosing techniques to provide this functionality are shown in U.S. Pat. Nos. 4,944,072, 5,070,584, 5,138,750, 5,140,727, 5,154,086, 5,363,540, 5,403,094 and published European applications EP A 90314084.5 and EP A 92301996.2 which are incorporated herein by reference.

The container bottom may also include vertical ribs on the sidewalls. The vertical ribs would increase the strength of the sidewalls and allow the sidewalls to be thinner.

The container top may also include a shape to hold an aluminum can, water bottle or second container in either a horizontal or vertical position. For example, the container top may include a two upwardly extending arms or a cradle surface which would hold the second container in a horizontal position. As another example, the container top may include a circular recess which would hold the second container in a vertical position.

The container may include a clip-on drink container. For example, the container bottom may have two outwardly extending arms and a bottom platform which would hold a drink container.

The container top may include a dome surface to increase the volume of the container and/or to allow the user to create a vacuum in the container upon sealing. For example, in order to create a vacuum, the user may depress the dome surface during the closing of the container. The dome surface will attempt to return to its relaxed position and create a vacuum.

In addition, the container may include a self-venting feature. The pressure in the sealed container may increase when the sealed container and contents are heated in a microwave oven. Thus the container top may include a self-venting mechanism which opens when the pressure in the container exceeds a predetermined value.

The container bottom may include a peelable lid with a super seal. Specifically, in a commercial use, the container bottom may include an interior peelable lid which is glued to the closure device.

In another embodiment, the peelable lid would release or vent when the sealed container and contents are heated in a microwave oven. Specifically, the heat would weaken the glue and allow the pressure to escape and/or the glue would be the weakest point of the container and allow the pressure to escape.

The container may be divided to separate various foods in the container. The divider would permit the user to store one food in one compartment and another food in another compartment. The divider may be integral with the container or a separate component. In addition, only the container bottom may include a divider or both the container bottom and the container top may each include a divider.

FIGS. 32–42 illustrate one example of a dual compartment container 700 constructed in accordance with the present invention. The dual compartment container 700 shares many of the same features of the previously described embodiment and all structural elements of the dual compartment container 700 that are common to any of the previously described embodiments are indicated by the same reference numerals. All criteria concerning the preferred materials of construction, material properties and representative starting sheet thicknesses as described above in connection with the single compartment container embodiments are applicable to the dual compartment container 700 discussed below.

The dual compartment container 700 consists of a flexible plastic container bottom 702 and a flexible plastic container top 704.

Figure 33:
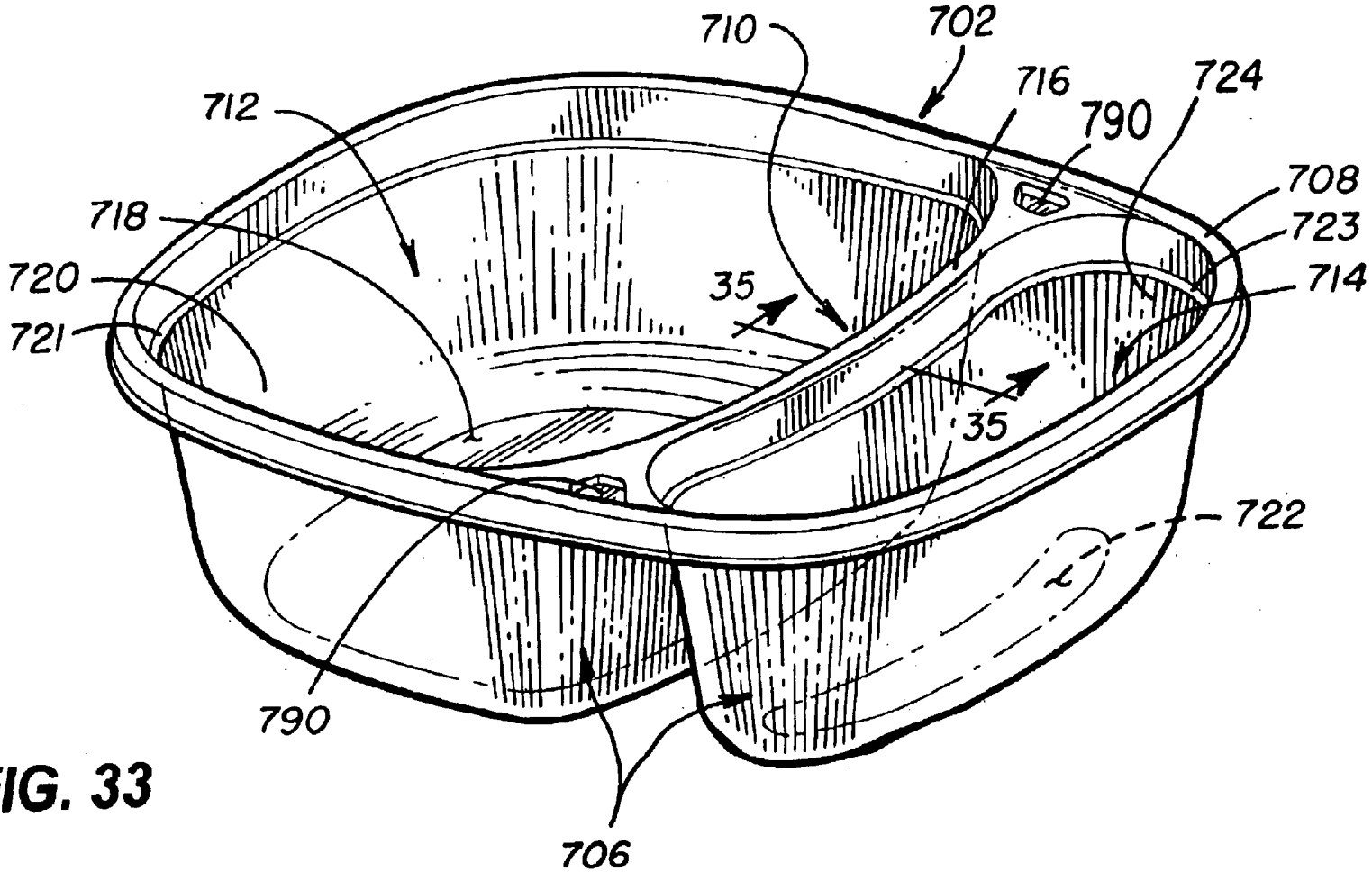
FIG. 33 is a top perspective view of the dual compartment container bottom of FIG. 32.

Referring to FIG. 33, the container bottom 702 includes a continuous first body portion 706 and a continuous first closure portion or closure device (the terms are used interchangeably herein) 708 encompassing said first body portion 706. In this embodiment, the first body portion 706 includes at least one container bottom partition 710 dividing the first body portion 706 into at least two base compartments 712, 714. The container bottom partition 710 includes a second closure portion or closure device 716 that is formed continuous with said first closure portion 708. Base compartment 712 is defined by a bottom wall 718 and a continuous side wall 720. The continuous side wall 720 encompasses the bottom wall 718 and extends upwardly and outwardly from the bottom wall 718. A stacking recess 719 is formed in the bottom wall 718 (see FIG. 32). At the termination of the continuous sidewall 720 there is provided a denesting shoulder 721 which merges into both the closure portion 708 and the closure portion 716. In similar fashion, base compartment 714 is defined by a bottom wall 722 and a continuous side wall 724. The continuous side wall 724 encompasses the bottom wall 722 and extends upwardly and outwardly from the bottom wall 722. A stacking recess 725 is formed in the bottom wall 722 (see FIG. 32). At the termination of the continuous sidewall 724 there is provided a denesting shoulder 723 which merges into both the closure portion 708 and the closure portion 716. The container bottom partition 710 includes adjacent and opposing sections of the side walls 720 and 724. The first closure portion or closure device 708 preferably uses the same dual cut-back configuration as previously described in connection with the single compartment container embodiments. On the other hand, the second closure portion or closure device 716 is a little different and has a closure width that varies in correspondence to the divider width, which is designed to flare at the junction points with the first closure portion 708.

Figure 35:
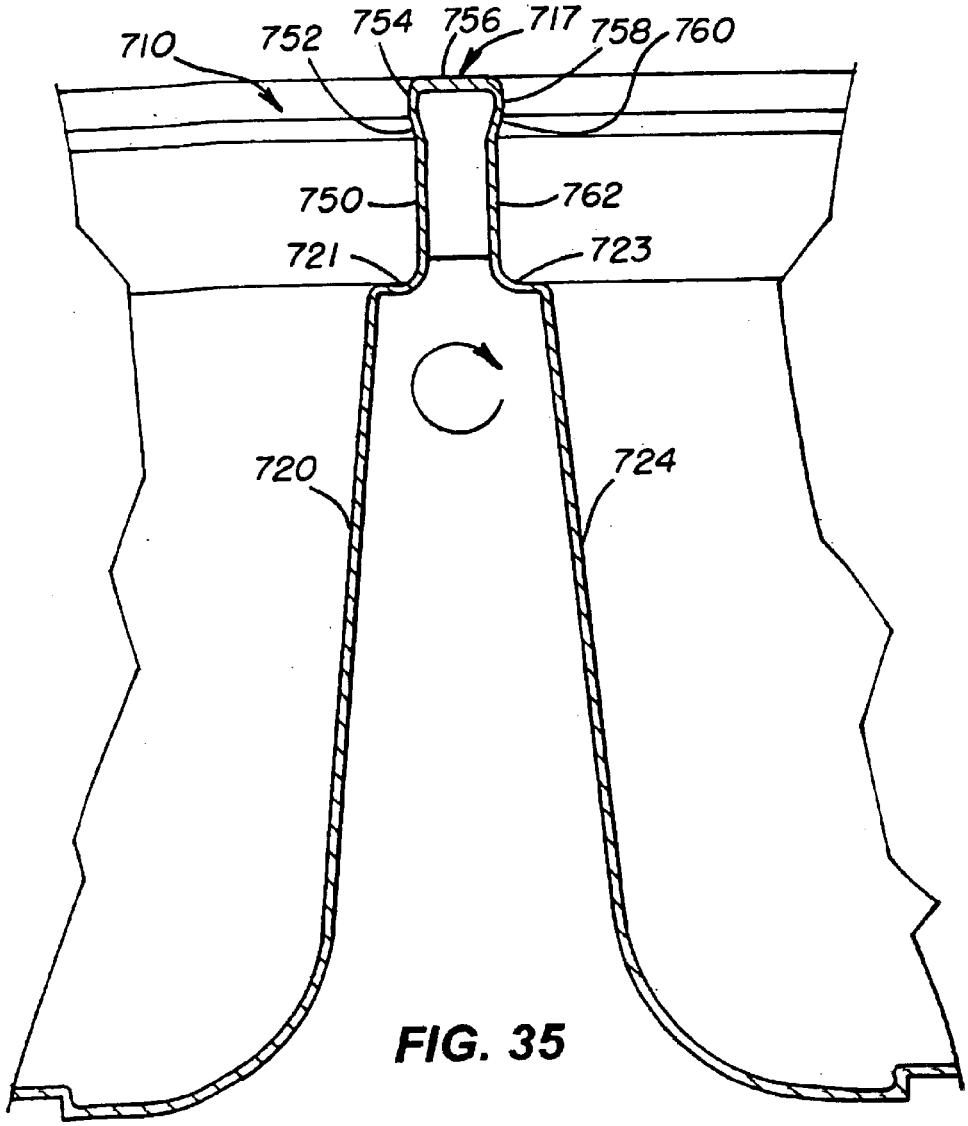
FIG. 35 is an enlarged cross-sectional view taken along line and in the direction of arrows 35—35 of FIG. 33.

As is best seen in FIG. 35, the second closure portion 716 of the container bottom partition 710 is formed from a plurality of linear segments. In clockwise fashion, the linear segments that make up the second closure portion 716 include vertical sealing wall 750, left side cut back 752, left side lead in portion 754, horizontal rim surface 756, right side lead in portion 758, right side cut back 760 and vertical sealing wall 762. In a preferred embodiment the left and right side elements are substantially mirror images of each other. It is understood that in addition to the linear segments specifically disclosed herein, the left and right side cut-back portions 752, 760 may also consist of mirror image arc segments or a combination of arc and linear segments (in which case the left and right side cut-backs would not be mirror images of each other).

Figure 34:
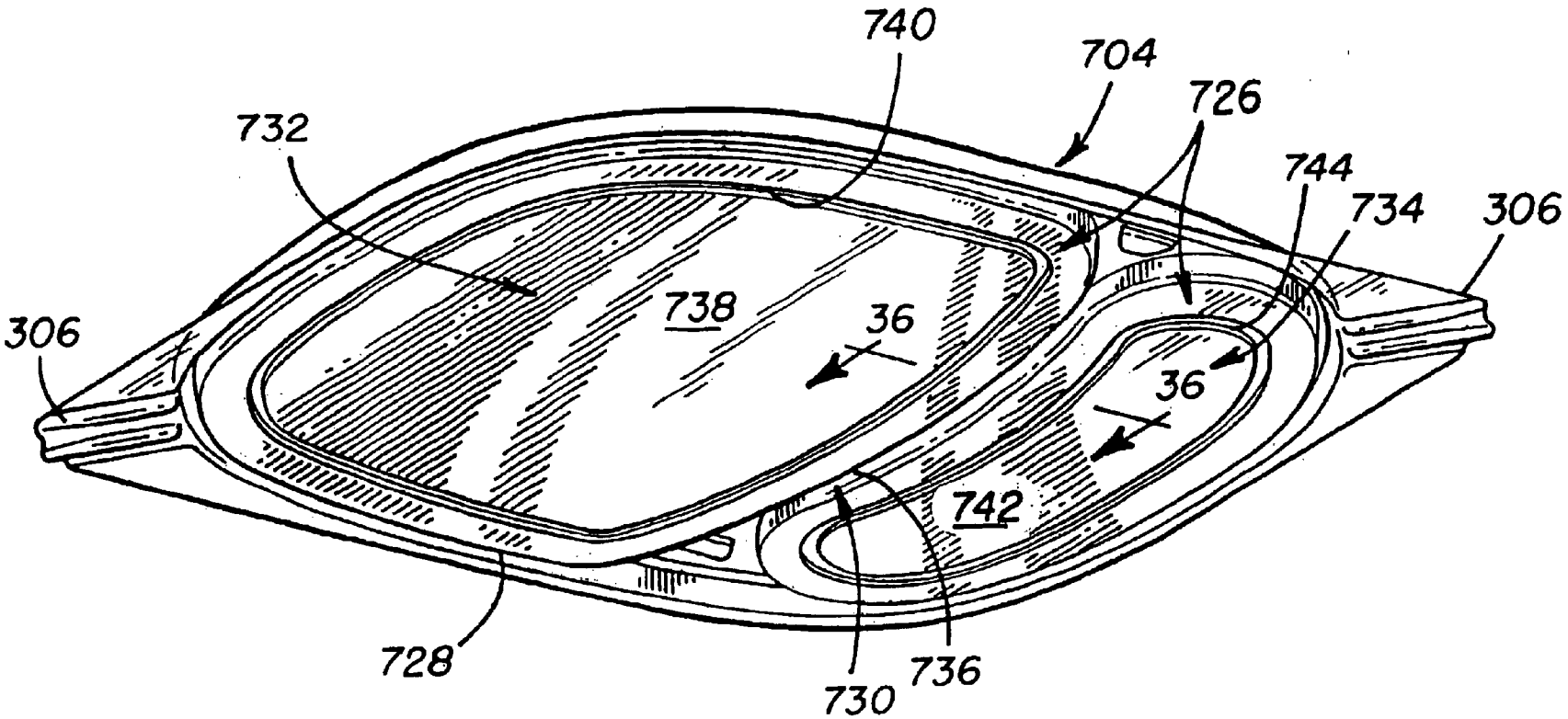
FIG. 34 is a bottom perspective view of the dual compartment container top of FIG. 32.

Referring to FIG. 34, the container top 704 includes a continuous second body portion 726 and a continuous third closure portion 728 encompassing the second body portion 726. The continuous second body portion 726 includes at least one container top partition 730 dividing the second body portion 726 into at least two container top compartments 732, 734. The container top partition 730 includes a fourth closure portion 736 that is formed continuous with said third closure portion 728. Top compartment 732 includes a top wall 738 and a stacking bead 740. In similar fashion, top compartment 734 includes a top wall 742 and a stacking bead 744.

Figure 36:
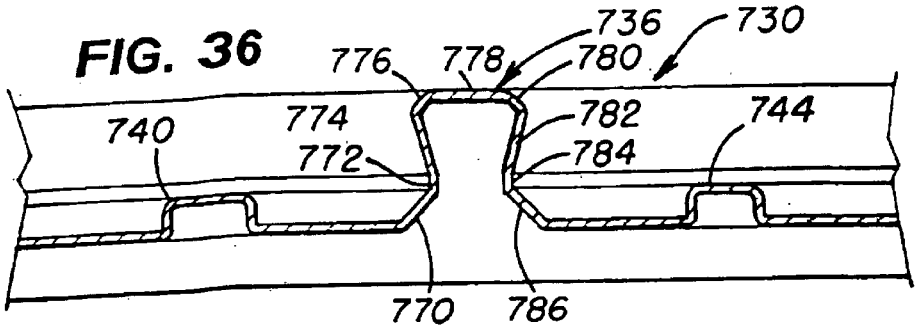
FIG. 36 is an enlarged cross-sectional view taken along line and in the direction of arrows 36—36 of FIG. 34.

As is best seen in FIG. 36, the fourth closure portion 736 of the container top partition 730 is formed from a plurality of linear segments. In clockwise fashion, the linear segments that make up the fourth closure portion 736 include upwardly and inwardly inclined left side lead in portion 770, left side vertical sealing wall 772, left side cut back 774, upwardly and inwardly extending portion 776, horizontal rim surface 778, downwardly and outwardly extending portion 780, right side cut-back portion 782, right side vertical sealing wall 784,and downwardly and outwardly right side lead in portion 786. In a preferred embodiment the left and right side elements are mirror images of each other. It is understood that in addition to the linear segments specifically disclosed herein, the left and right side cut-back portions 774, 782 may also consist of mirror image arc segments or a combination of arc and linear segments (in which case the left and right side cut-backs would not be mirror images of each other).

Figure 37:
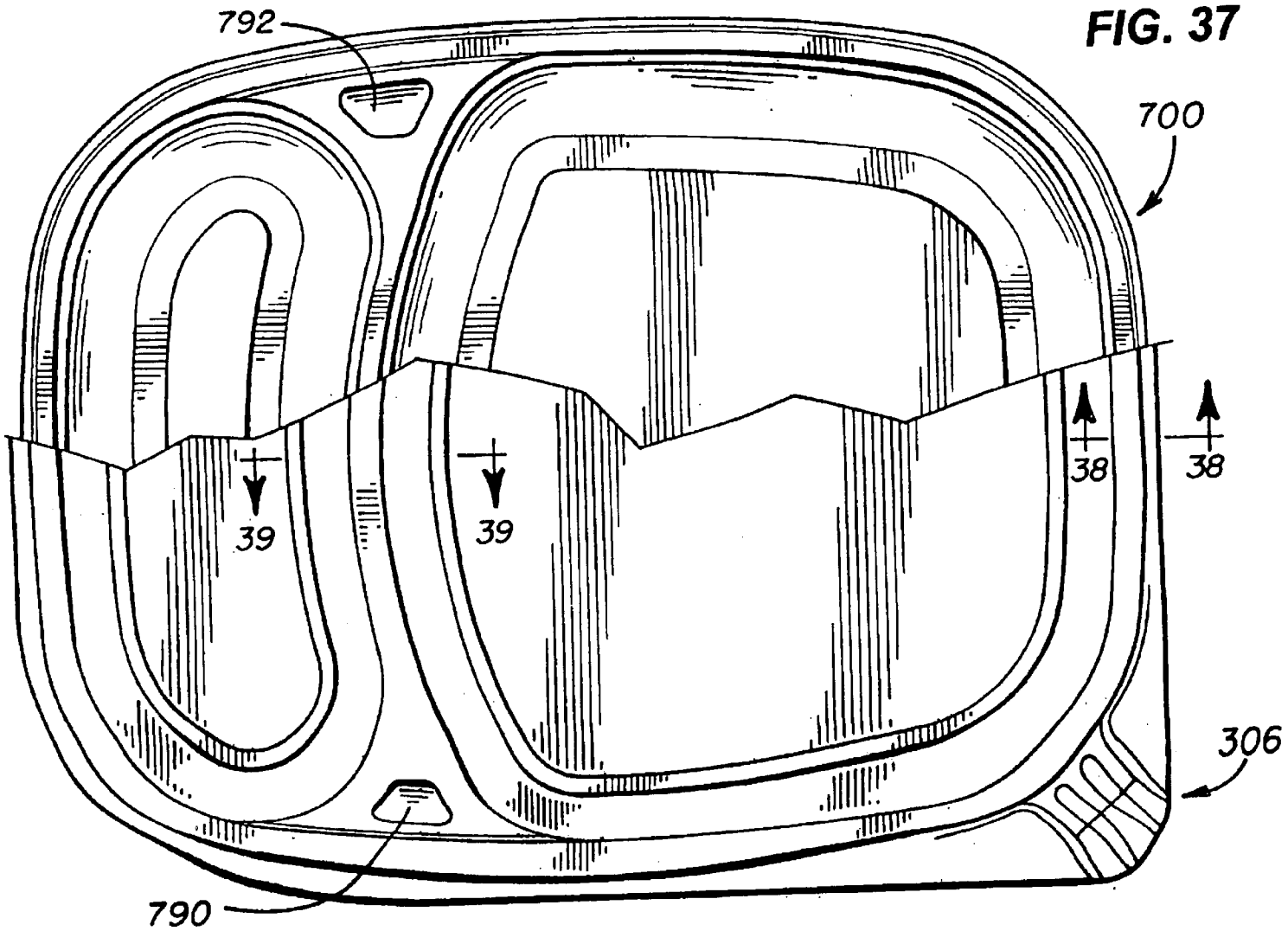
FIG. 37 is a top plan view of another dual compartment container shown with a lengthwise half portion of the container top removed.
Figure 38:
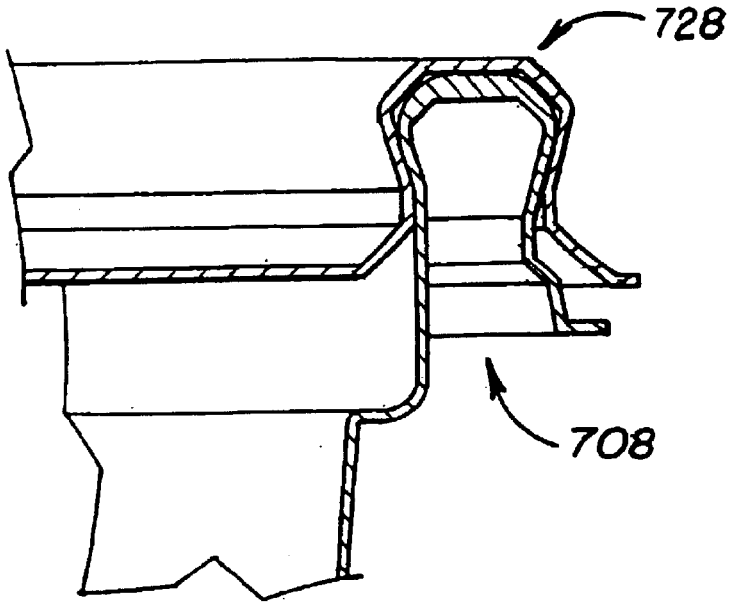
FIG. 38 is an enlarged cross-sectional view taken along line and in the direction of arrows 38—38 of FIG. 37.
Figure 39:
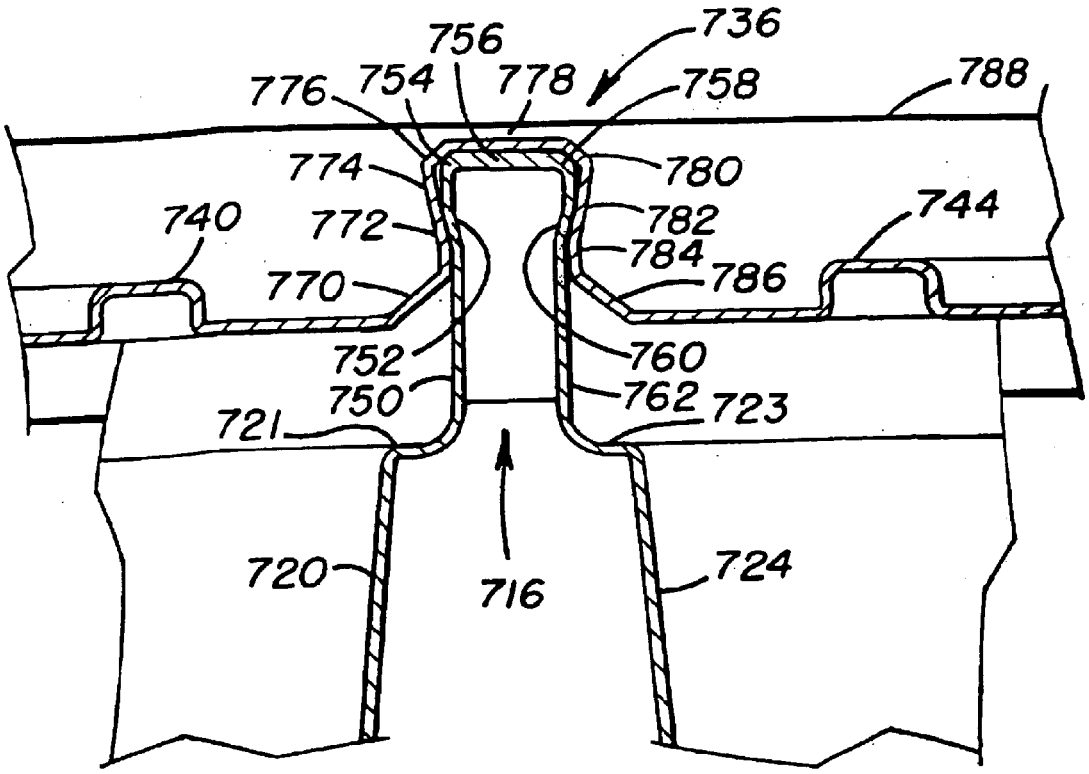
FIG. 39 is an enlarged cross-sectional view taken along line and in the direction of arrows 39—39 of FIG. 37.
Figure 40:
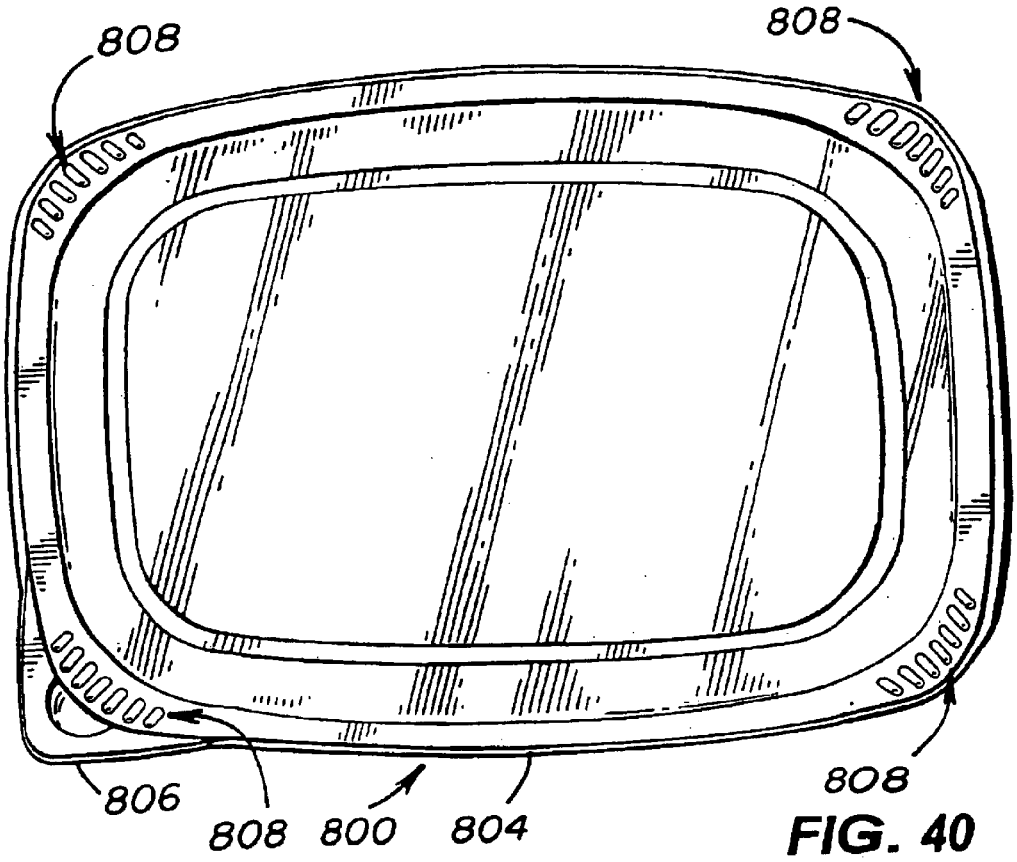
FIG. 40 is a top plan view of a container for food in accordance with another embodiment of the present invention.
Figure 41:
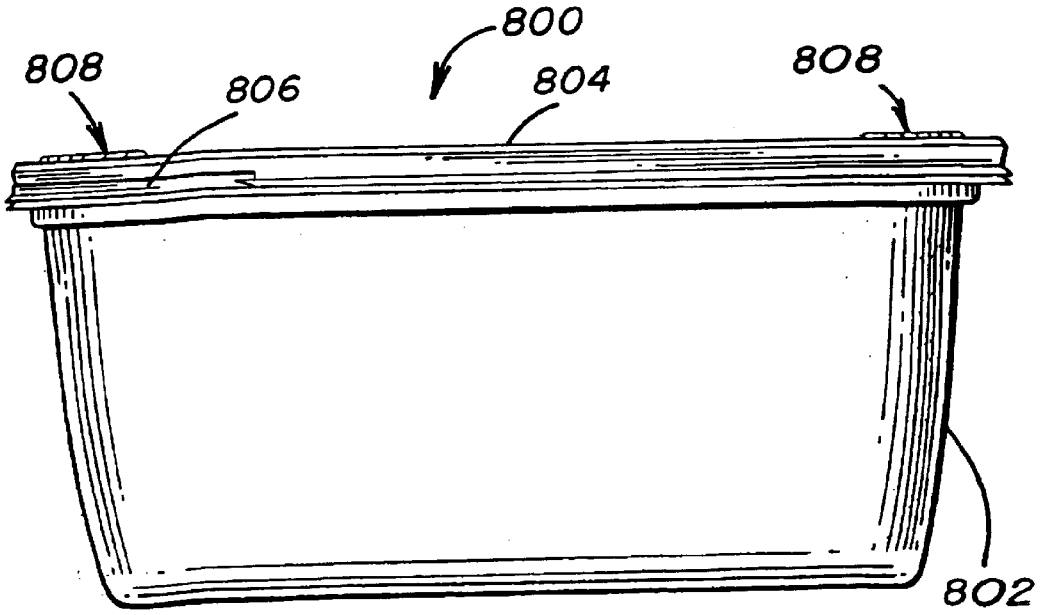
FIG. 41 is a side elevational view of the container of FIG. 40.
Figure 42:
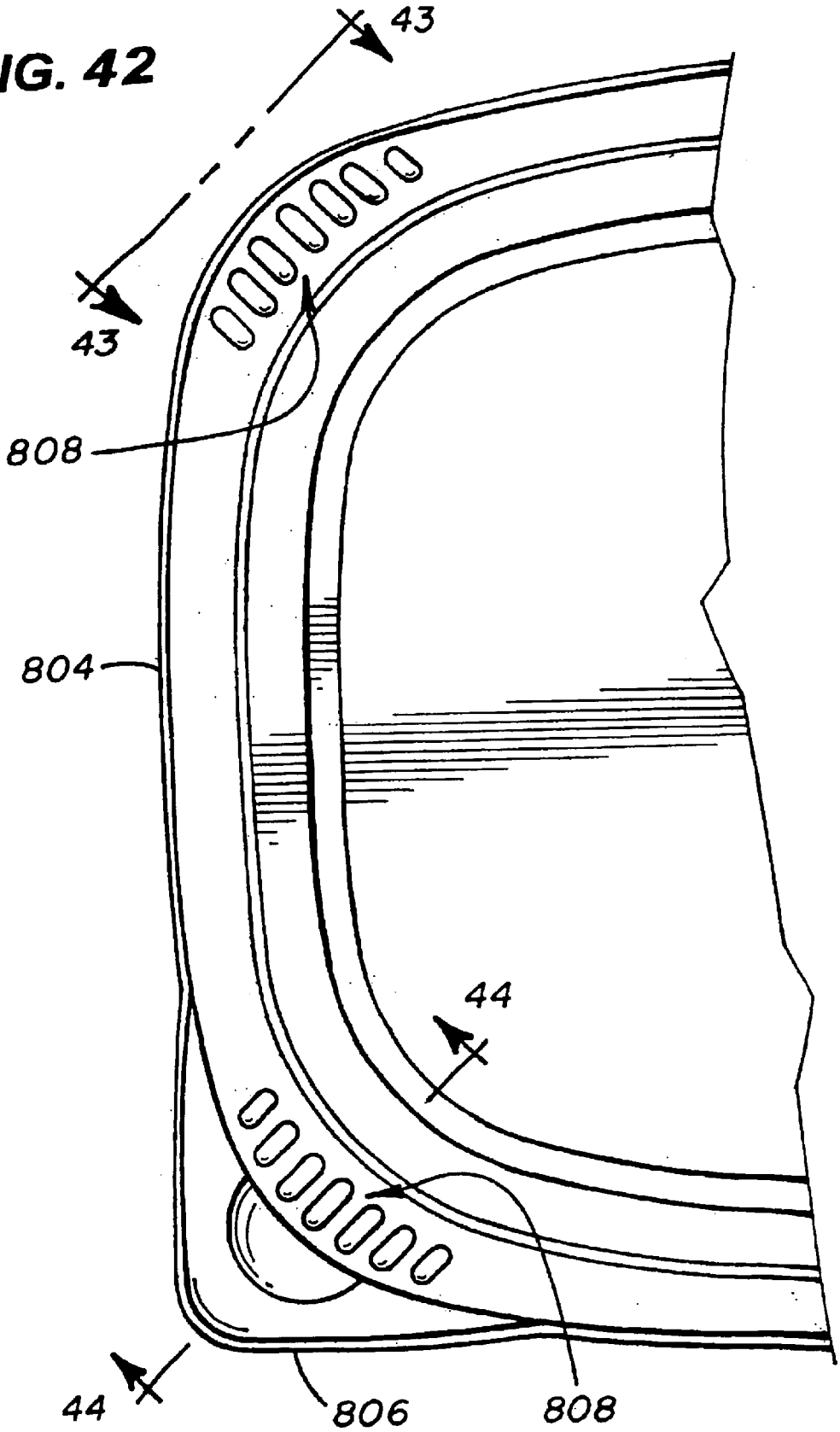
FIG. 42 is an enlarged fragmentary top view of the container top of FIG. 40.
Figure 43:
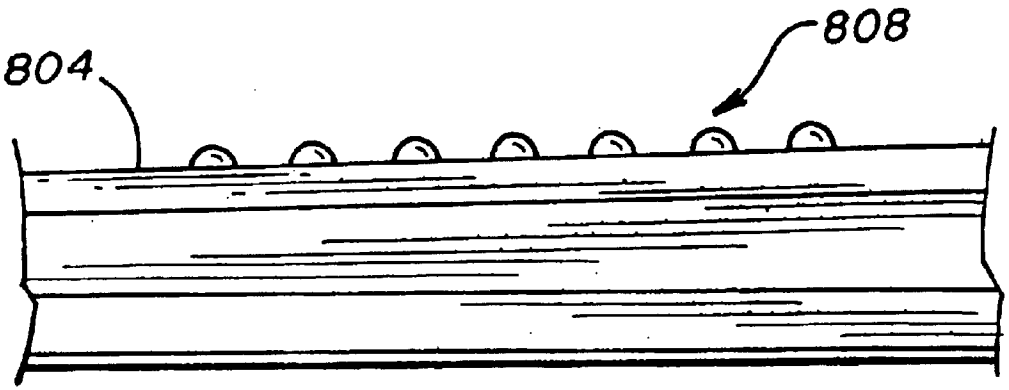
FIG. 43 is an end view taken along line and in the direction of arrows 43—43 of FIG. 42.
Figure 44:
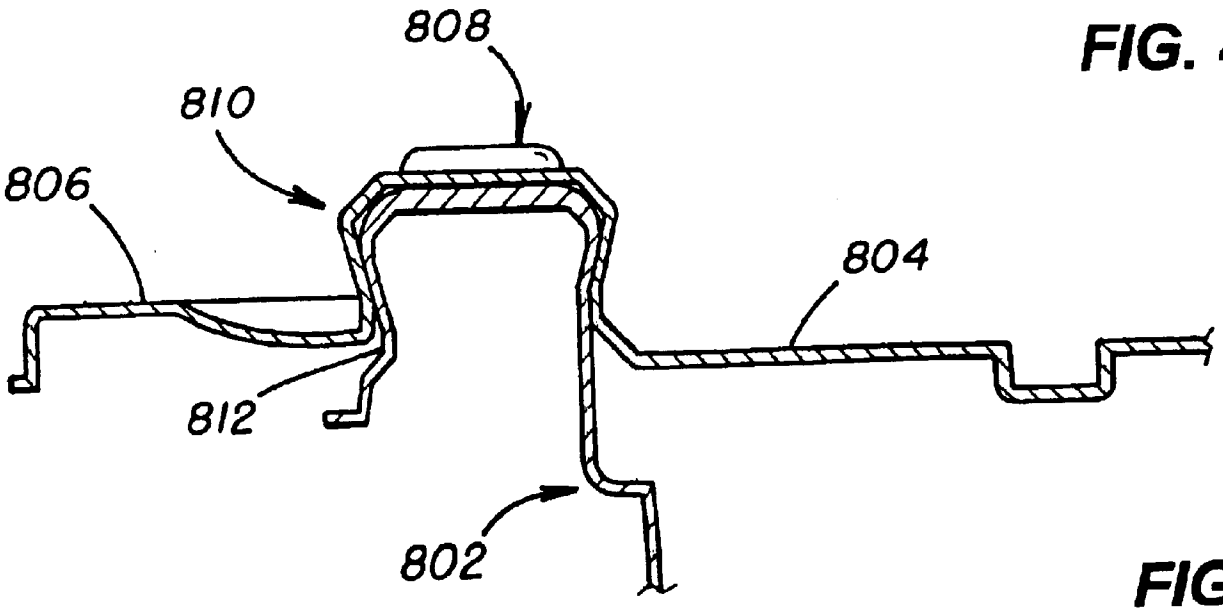
FIG. 44 is a cross-sectional view taken along line and in the direction of arrows 44—44 of FIG. 42.

With reference now to FIGS. 37–39, the engagement between dual compartment container bottom 702 and dual compartment container top 704 will now be described. It is noted that the dual compartment container shown in FIG. 37 is substantially identical to the dual compartment container of FIG. 32 with the exception that the dual compartment container of FIG. 37 is shown with only a single gripping tab 306. The engagement between the first closure portion 708 of the dual compartment container bottom 702 and the third closure portion 728 of the dual compartment container top 704 as depicted in FIG. 38 is substantially identical to the engagement between the container bottom closure device 136 and the container top closure device 308 of the single compartment container described above with reference to FIG. 17C and a further description will not be repeated here for the sake of brevity.

As seen in FIG. 39, the second closure portion 716 of the dual compartment container bottom 702 is engaged by the fourth closure portion 736 of the dual compartment container top 704. The sealing engagement between the second and fourth closure portions 716, 736 is accomplished by positioning the lead-in portions 770, 786 of the container top partition 730 container top over the lead-in portions 754, 758 of the container bottom partition 730. A vertical force is then applied to the container top 704 to overcome the interference between the closure portions 716, 736. The cut-back portions 774, 782 of the thinner container top partition 730 deflect horizontally while passing over the lead-in portions 754, 758 of the container bottom partition 710. Once beyond the lead-in portions 754, 758 of the container bottom partition 710, the cut-back portions 774, 782 of the container top partition 730 retract inwardly against the cut-back portions 752, 760 of the container bottom partition 710. The retracting forces of the cut-back portions 774, 782 of the container top partition 730 cause the container top 704 to move downwardly until the horizontal surface 778 of the container top partition 730 rests against the horizontal rim surface 756 of the container bottom partition 710. In addition, the force created by the expanded cut-back portions 774, 782 causes the container top 704 to audibly snap into place, indicating that the container is securely closed. This occurs in combination with the sealing engagement between the first and third closure portions 708, 728.

Preferably, the container bottom partition 710 is curved to provide increased rigidity along a length-wise direction of the container bottom 702 (the container top partition 730 is conformingly curved to match the contour of the curved container bottom partition 710). As best seen in FIG. 39, the elevation of the second and fourth closure regions is slightly lower than the elevation of the first and third closure regions (as indicated by line 788). This slight differential in elevation also contributes to enhanced rigidity of the container bottom 702 in the length-wise direction.

The dual compartment container 700 may also be provided with centering means for assisting in centered engagement between the dual compartment top 704 and the dual compartment bottom 702. In a preferred embodiment, the centering means include depressions 790 formed in the horizontal rim surface 756 adjacent the opposed flared ends of the container bottom partition 710. The depressions 790 are sized to receivingly engage, with an interference fit, conformingly shaped protrusions 792 formed in the horizontal rim surface 778 of the container top partition 730. In a preferred embodiment, the depressions 790 and protrusions 792 are substantially isosceles trapezoidal in configuration with a long dimension in the lengthwise orientation of the dual compartment bottom 702.

The container may also include a rough exterior surface to reduce slipping and improve grasping by the user. For example, the exterior of the container bottom may have a textured surface, as opposed to a smooth surface, to improve handling by the user, especially if the user's hands are wet or greasy.

Figure 45:
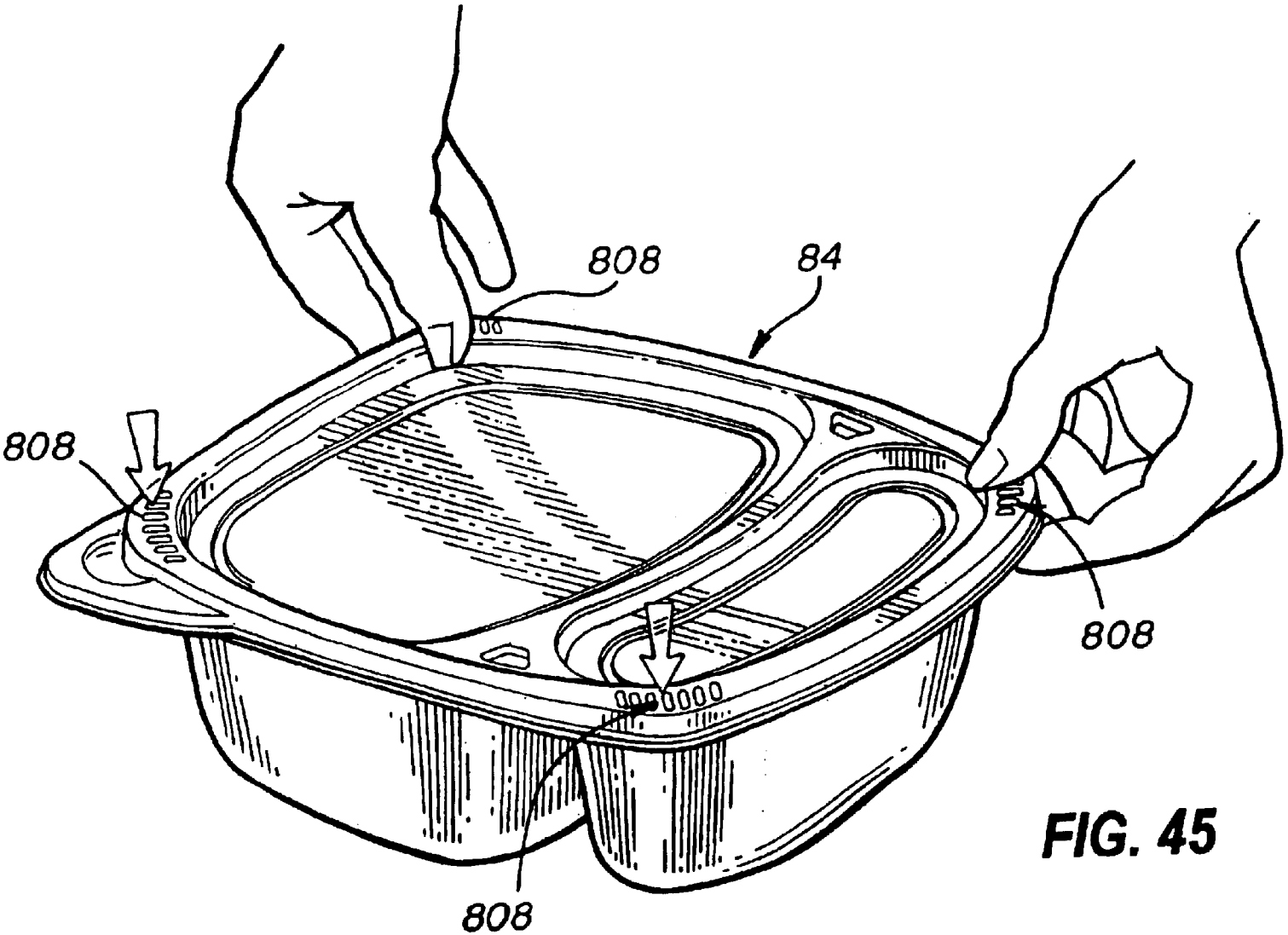
FIG. 45 is a top perspective view of a dual compartment container for food in accordance with another embodiment of the present invention.

FIGS. 40–44 illustrate another embodiment of the present invention similar to that described in FIGS. 1–17E which includes some textured regions to improve handling by the user. The container 800 consists of a container bottom 802 and a container top 804. In this embodiment the container top 804 is provided with only a single gripping tab 806. The four corners of the container top 804 are provided with surface texturing in the form of upraised ribs 808 to improve handling by a user. The respective closure regions of the container bottom 802 and container top 804 are also wider at the corner regions than they are in between the corner regions. The combination of widened corner regions and textured areas on the corner regions provides the user with conspicuous pressure points to affect a rapid and leak proof closure of the container top onto the container bottom. For the single compartment container 800, the user may achieve a two-touch rapid closure by first simultaneously depressing one pair of adjacent corner regions and then simultaneously depressing the remaining adjacent corner pair. For the dual compartment container 840 shown in FIG. 45, a third touch at the divider area is typically required to achieve a complete leak proof closure. As before, the tab 806 are co-joined with a portion of the closure device 810 of the container top 804 so as to provide a recess 812 in the outermost portion of the closure device 810 to facilitate removal of the container top 804 from the container bottom 802 (see FIG. 44). As described above in connection with the embodiment of FIG. 14, the recess 812 provides less interference contact yet still provides sufficient contact in order to maintain proper sealing The container may also include a temperature-indicating strip which would indicate the temperature of the container and contents. In one embodiment, the temperature strip could indicate the approximate temperature of the container and contents. In another embodiment, the temperature strip could indicate whether the container and content are within one of several temperature ranges. In a third embodiment, the temperature strip could indicate whether the container and contents are either hot or cold.

While the invention is described in connection with these embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. A plastic container comprising:

a container bottom including a first closure portion, said first closure portion includes a first inner wall and a third outer undercut;

a container top including a second closure portion, said second closure portion having a second inner undercut and a fourth outer undercut; and said first closure portion being engagable to said second closure portion to secure said container top to said container bottom, wherein said first inner wall engages said second inner undercut to form a first continuous peripheral seal and said third outer undercut engages said fourth outer undercut to form a second continuous peripheral seal.

2. The invention as in claim 1 wherein said second closure portion includes an upwardly and inwardly extending second lead-in portion and a downwardly and outwardly extending fourth lead-in portion.

3. The invention as in claim 1 wherein said container bottom include volume markings on at least one side wall thereof.

4. The invention as in claim 3 wherein said volume markings are formed into the material of said container bottom.

5. A plastic container comprising:

a container bottom including a first closure portion having a first longitudinal center axis, said first closure portion having a first inner sealing surface and a third outer sealing surface, each of said first and third sealing surfaces diverge upwardly and outwardly relative to said first longitudinal axis;

a container top including a second closure portion, said second closure portion having a second longitudinal axis, said second closure portion having a second sealing surface and a fourth sealing surface, each of said second and fourth sealing surfaces converge downwardly and inwardly relative to said second longitudinal axis;

said first closure portion being engagable to said second closure portion to secure said container top to said container bottom and to form at least two continuous peripheral seals.

* * * * *